US008037707B2

(12) United States Patent
Lee et al.

(10) Patent No.: US 8,037,707 B2
(45) Date of Patent: Oct. 18, 2011

(54) AIR CONDITIONER

(75) Inventors: Jong Ho Lee, Kimhae-si (KR); Moon Shin Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 615 days.

(21) Appl. No.: 11/710,574

(22) Filed: Feb. 26, 2007

(65) Prior Publication Data

US 2008/0104988 A1 May 8, 2008

(30) Foreign Application Priority Data

Nov. 6, 2006 (KR) ..... 10-2006-0109170

(51) Int. Cl.
*F25D 21/14* (2006.01)

(52) U.S. Cl. ..... 62/285

(58) Field of Classification Search ..... 62/285, 62/279, 259.4, 259.1
See application file for complete search history.

(56) References Cited

U.S. PATENT DOCUMENTS

| | | | | |
|---|---|---|---|---|
| 5,638,693 | A | 6/1997 | Baek | |
| 5,732,565 | A * | 3/1998 | Ramakrishnan et al. | 62/298 |
| 6,134,909 | A * | 10/2000 | Lyu | 62/404 |
| 6,161,609 | A * | 12/2000 | Ahn | 165/41 |
| 6,168,248 | B1 | 1/2001 | Timmons et al. | |
| 6,218,752 | B1 | 4/2001 | Chang et al. | |
| 6,357,247 | B1 | 3/2002 | Moretti | |
| 6,425,256 | B1 | 6/2002 | Bushnell et al. | |
| 6,487,867 | B1 * | 12/2002 | Herren | 62/150 |
| 7,010,928 | B2 * | 3/2006 | Spanger | 62/150 |
| 2002/0000093 | A1 | 1/2002 | Lea | |
| 2002/0023445 | A1 | 2/2002 | Sul et al. | |
| 2003/0221439 | A1 | 12/2003 | Bush et al. | |
| 2005/0138939 | A1 | 6/2005 | Spanger | |
| 2006/0208915 | A1 | 9/2006 | Oakner et al. | |

FOREIGN PATENT DOCUMENTS

| | | |
|---|---|---|
| CN | 2555478 | 6/2003 |
| CN | 1427221 | 7/2003 |
| CN | 1740620 | 3/2006 |
| CN | 1789852 | 6/2006 |
| EP | 1 677 053 A1 | 7/2006 |
| GB | 2 275 330 A | 8/1994 |
| JP | 8-296870 | 11/1996 |
| JP | 2005-299978 | 10/2005 |
| KR | 252478 | 8/2001 |

* cited by examiner

*Primary Examiner* — Melvin Jones
(74) *Attorney, Agent, or Firm* — McKenna Long & Aldridge LLP

(57) ABSTRACT

An air conditioner is provided. The air conditioner according to an embodiment of the present invention includes: a base pan constituting a lower appearance: and a condensed water detector detecting the amount of condensed water collected on the base pan. The air conditioner according to another embodiment of the present invention includes: a base pan constituting a lower appearance; a blower unit provided at one side of the base pan to guide a flow of air; and a motor providing a fan with a rotational power, wherein a motor support supporting the motor is further installed on the base pan.

14 Claims, 26 Drawing Sheets

AIR CONDITIONER

This application claims the benefit of Korean Patent Application No. 10-2006-0109170 filed on Nov. 6, 2006, which is hereby incorporated by reference for all purposes as if fully set forth herein.

BACKGROUND OF THE INVENTION

1. Field of the Invention

The present invention relates to an air conditioner, and more particularly, to an air conditioner configured to enable a smooth flow of condensed water falling on a base pan, and a foreign particle filtering, to detect the amount of the condensed water collected on the base pan from an outward position of the air conditioner and selectively drain the condensed water, to have a groove for preventing an interference with a peripheral part and to be further provided with a motor support, in order to make the product more compact and strong.

2. Description of the Related Art

Generally, an air conditioner includes a compressor, an outdoor heat exchanger, an expansion valve, and an indoor heat exchanger, and is used for maintaining an indoor space at a set temperature to make the indoor space a pleasant environment. That is, an air conditioner is a cooling/heating apparatus installed in a predetermined portion or a wall surface of an interior space such as a vehicle, an office, and a home to cool or heat the interior space. The air conditioner employs a cooling cycle involving a compressor, an outdoor heat exchanger, an expansion valve (a capillary tube), and an indoor heat exchanger or a heating cycle in series using reverse circulation of a coolant. However, since a related art air conditioner is large in scale and is installed and used on a wall of a building, it is difficult to move the air conditioner once it is installed. That is, it is impossible to move the related art air conditioner, which causes inconvenience in using the air conditioner. Therefore, a mobile air conditioner having moving wheels attached on a bottom of the air conditioner to allow a user to easily move the air conditioner has recently been developed. Utility model No. 0252478 registered in the Korea Intellectual Property Office (KIPO) discloses this related art mobile type air conditioner.

However, like in the related art, only releasing the condensed water may not take place a smooth evaporation of the condensed water. Accordingly, it is difficult to eliminate the condensed water, so that the condensed water overflows and is leaked to badly influence other parts. In addition, in the related art air condition, it is impossible to conceive the amount of the condensed water collected therein from an outside of the air conditioner product.

Furthermore, since the related art air conditioner does not have a constitution for filtering a foreign particle contained in the condensed water, peripheral parts may be contaminated or disordered due to the foreign particle contained in the condensed water.

SUMMARY OF THE INVENTION

Accordingly, the present invention is directed to an air conditioner that substantially obviates one or more problems due to limitations and disadvantages of the related art.

An object of the present invention is to provide an air conditioner provided with condensed water control means that can allow a user positioned outside the air conditioner to easily grasp the amount of the condensed water collected therein and can easily drain the condensed water collected therein.

Another object of the present invention is to provide an air conditioner that can prevent a motor from moving, and be provided with a base pan having various shapes so as not to cause an interference with a peripheral part, thus making the air condition product compact.

A further object of the present invention is to provide an air conditioner that can filter a foreign particle contained in condensed water while the condensed water flows.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an air conditioner including: a base pan constituting a lower appearance; and a condensed water detector detecting the amount of condensed water collected on the base pan.

In another aspect of the present invention, there is provided an air conditioner including: a base pan constituting a lower appearance; a blower unit provided at one side of the base pan to guide a flow of air; and a motor providing a fan with a rotational power, wherein a motor support supporting the motor is further installed on the base pan.

In a further aspect of the present invention, there is provided an air conditioner including: a base pan constituting a lower appearance; a heat exchanger provided at one side of the base pan to exchange heat between air and coolant, wherein the base pan comprises a heat exchanger installing part in which the heat exchanger is installed.

According to an air conditioner of the present invention, the condensed water detector detecting the amount of the condensed water collected on the base pan is installed, and a signal detected by the condensed water detector is transmitted to a display part installed on a front frame to display information to a user positioned outside the air conditioner. Accordingly, the user can easily grasp the collected amount of the condensed water from the outside of the air conditioner.

Also, drain control means is provided in the base pan such that a user can drain the condensed water collected therein to the outside. Accordingly, the condensed water can be in advance prevented from overflowing and being leaked or being penetrated into other products, so that electric shock or surrounding pollution can be prevented.

Furthermore, in the air condition according to the present invention, a housing groove guiding air flowing by a fan is formed protruded downward at a lower send of an orifice and an air guide, and a housing base recess for avoiding an interference with the housing groove is formed recessed downward. Accordingly, a space occupied by parts is reduced as a whole to enable a miniaturization of the product.

Moreover, a motor support doubly supporting the motor coupled to the air guide is further provided. Accordingly, the motor, the air guide and the base pan are coupled to one another by the motor support, so that the motor can be prevented from being decoupled and the product becomes stronger. Additionally, since the main drain pan as well as the drain pan is indirectly coupled to the base pan, the product becomes strong as a whole. Accordingly, the endurance is enhanced.

Also, in the present invention, foreign particles contained in the condensed water are doubly filtered by a foreign particle shielding rib. Accordingly, it is prevented that the foreign particles are introduced into an inside of a condensed water pump to cause a disorder of the pump or clog a flow path. In other words, the condensed water can flow smoothly.

Additionally, in the present invention, a separation wall or the like is formed which prevents the condensed water collected on the base pan from being leaked to a perimeter. Accordingly, it is prevented that the condensed water is introduced into a peripheral part to cause an electric leakage or other failure. Also, a bottom surface of the base pan is formed with a slope such that condensed water is collected toward one point, and a slot through which the condensed water passes is formed at each rib. Accordingly, the condensed water can be smoothly collected on the base pan and can smoothly flow.

Furthermore, a drain pipe cover constituting the drain control means according to the present invention is fixed to the base pan. Accordingly, the drain pipe cover can be prevented from being lost and a waste of time taken in searching the drain pipe cover as lost can be prevented.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
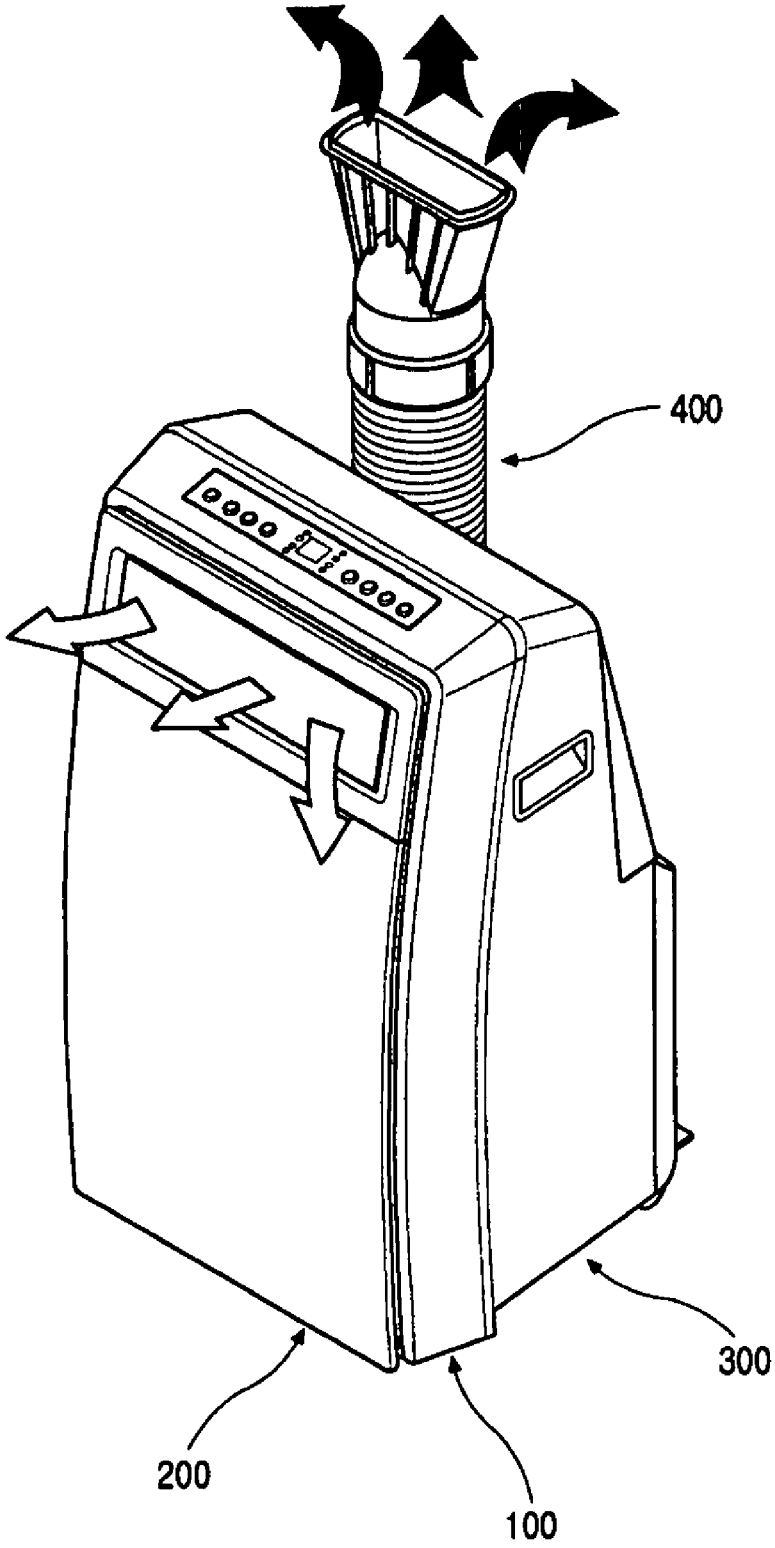
FIG. 1 is a front perspective view of an air conditioner according to a preferred embodiment of the present invention.
Figure 2:
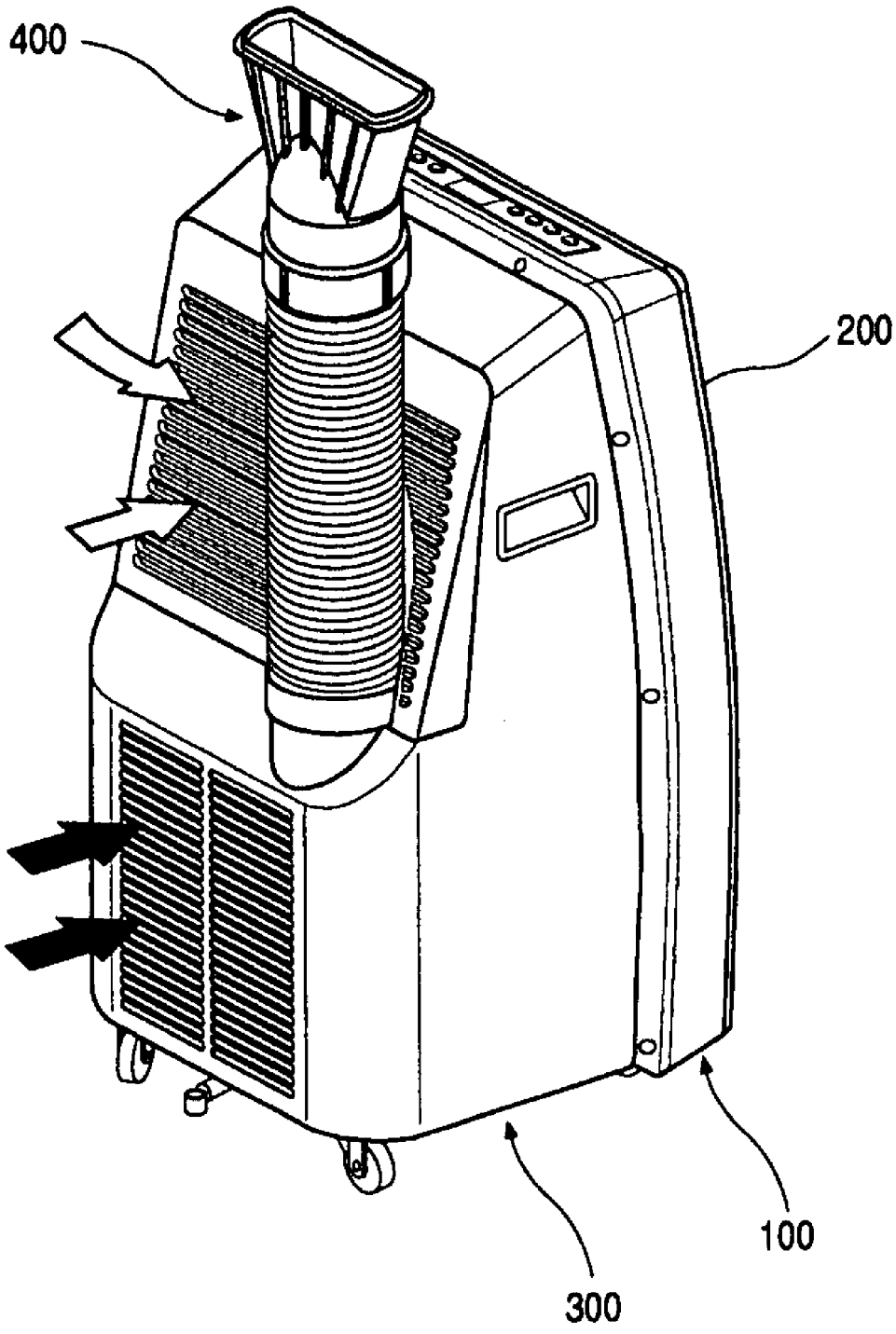
FIG. 2 is a rear perspective view of an air conditioner according to a preferred embodiment of the present invention.

FIGS. 1 and 2 are perspective views illustrating a front appearance and a rear appearance of an air conditioner according to the present invention, respectively.

Referring to FIGS. 1 and 2, the air conditioner includes a front frame 100 and a front panel 200 forming a front appearance, and a rear frame 300 forming a rear appearance, by which an entire appearance of the air conditioner is schematically formed.

The front frame 100 constitutes a framework of a front part of the air conditioner, and simultaneously, constitutes portions of appearances of upper and right/left sides. A manipulation panel 120 for allowing a user to manipulate the air conditioner is provided on the upper side.

The rear frame 300 is formed to constitute appearances of the upper and right/left sides as well as a rear side of the air conditioner. An exhaust guide element 400 is connected to the rear frame 300 to exhaust heat-exchanged air to the outside (particularly, an outdoor space). A construction of the exhaust guide element 400 will be described below in detail.

Figure 3:
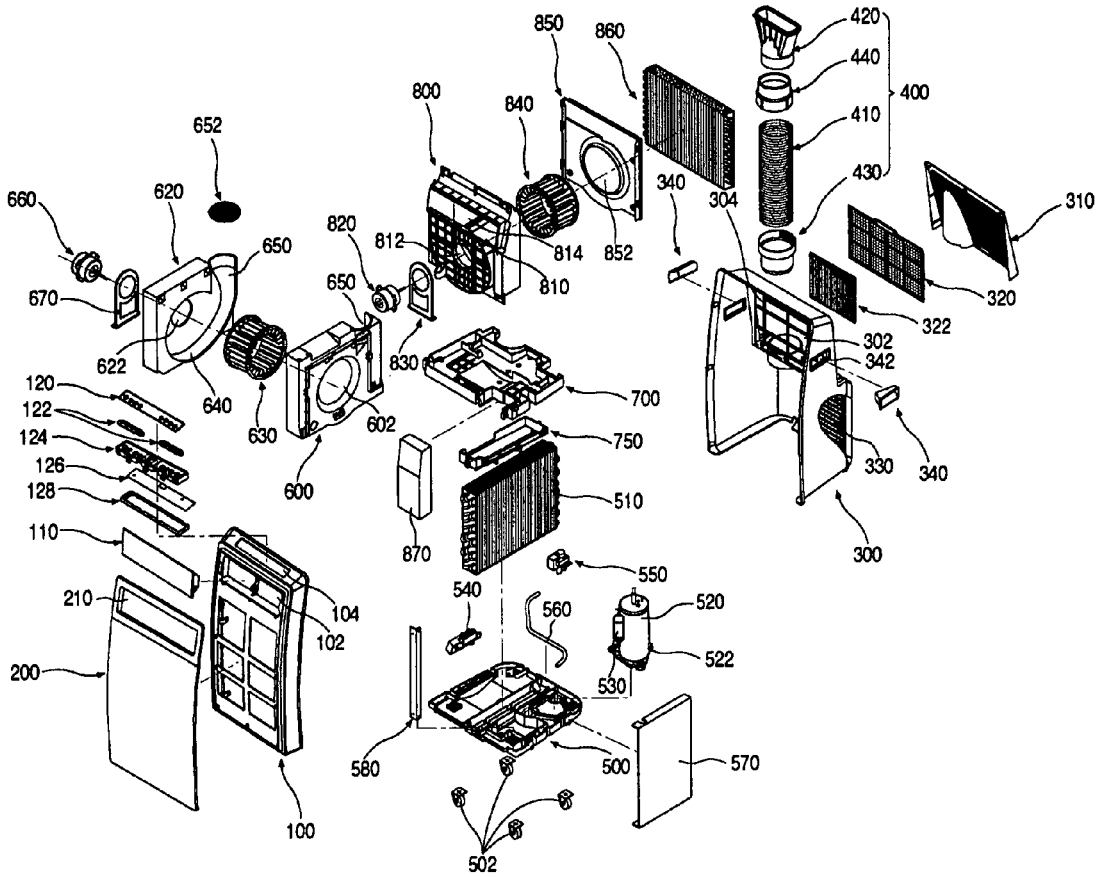
FIG. 3 is an exploded perspective view of an inner construction of an air conditioner according to an embodiment of the present invention.

FIG. 3 is an exploded perspective view of an inner construction according to an embodiment of the present invention. Referring to FIG. 3, the front frame 100 is formed in a quadrangular shape. Also, the front frame 100 has a central portion formed to relatively protrude further to a front side. Therefore, the front frame 100 is formed to have a rounded curvature on the whole when seen from a side direction.

A louver installation opening 102 is formed in the vicinity of an upper end of the front frame 100. The louver installation opening 102 is a portion in which a discharge louver 110 is installed. The louver installation opening 102 has a quadrangular shape formed horizontally long.

An upper surface of the front frame 100 is formed to be inclined to the front at a predetermined angle. A panel opening 104 in which a manipulation panel 120 is installed is formed in the upper surface of the front frame 100 to pass through the front frame 100. The panel opening 104 has a rectangular shape corresponding to a shape of the manipulation panel 120.

The front panel 200 is formed in a quadrangular flat plate to constitute a front appearance of the air conditioner. The front panel 200 is fixedly installed on a front side of the front frame 100. Therefore, the front panel 200 has a shape corresponding to the front side of the front frame 100. That is, like the front frame 100, the front panel 200 has a central portion whose upper end relatively protrudes further to the front than a lower end, to form a rounded shape (an arc shape).

A discharge louver 110 is installed in the louver installation opening 102 of the front frame 100 to guide air that has been air-conditioned to the outside. The discharge louver 110 controls a discharge direction of air, and includes a plurality of discharge ribs to allow air to be discharged to a horizontal direction or a vertical direction. The manipulation panel 120 is installed in the panel opening 104. The manipulation panel 120 is intended for a user's manipulation and includes a plurality of buttons installed to protrude to the outside. That is, a pair of button assemblies 122 is provided under the manipulation panel 120, and the plurality of buttons provided to the button assemblies 122 pass through the manipulation panel 120 and are exposed upward.

A manipulation printed circuit board (PCB) 124 is installed under the button assemblies 122. The manipulation PCB 124 converts button operations of the button assemblies 122 into signals and delivers the signals to a controller (not shown).

Meanwhile, a display part 125 is further disposed at a center of the manipulation PCB 124. The display part 125 is a region where a user's operation command or an operation status of the air conditioner is displayed to the outside of the air conditioner. Accordingly, the amount of the condensed water can be displayed on the display part 125 according to a signal transmitted from condensed water detector 540 to be described later.

The manipulation PCB 124 is supported by a manipulation frame 126. Also, an outside of the manipulation PCB 124 is surrounded by a rectangular box-shaped PCB case 128.

A air outlet 210 is formed in the vicinity of an upper end of the front panel 200 to pass through the front panel 200. The air outlet 210 is a portion through which air-conditioned (cooled or heated) air is discharged to the front, and has a rectangular shape corresponding to the discharge louver 110. The rear frame 300 is coupled to the front frame 100. Therefore, a front end of the rear frame 300 is molded in a shape corresponding to a shape of the front frame 100. That is, front ends of left and right sides of the rear frame 300 have a central portion protruding to the front to have a rounded curvature such that the front ends of the left and right sides correspond to rear ends of left and right sides of the front frame 100.

An external air inlet 302 is formed in an upper half portion of the rear frame 300 to pass through back and forth of the rear frame 300. The external air inlet 302 is formed in a quadrangular shape to serve as a passage through which air of an indoor space is sucked into the air conditioner.

A quadrangular filter frame 304 corresponding to the external air inlet 302 is further formed at a central portion of the external air inlet 302. The filter frame 304 is preferably formed in a size smaller than that of the external air inlet 302 to support such that a special filter such as a deodorization filter 322 is installed.

The external air inlet 302 is shielded by a suction grill 310. Indoor air passes through the suction grill 310 and flows into the air conditioner. For this purpose, a plurality of holes are formed in the suction grill 310 to pass through the suction grill 310. The suction grill 310 is formed to have a size corresponding to that of the external air inlet 302. More specifically, the suction grill 310 is formed to be slightly inclined to the front.

A pre-filter 320 is installed along an edge of the external air inlet 302. The pre-filter 320 is formed to have a size corresponding to a size of the external air inlet 302 to filter foreign substances contained in air that flows in through the suction grill 310.

A deodorization filter 322 is further provided on a front side of the pre-filter 320. The deodorization filter 322 is formed in a size corresponding to a size of the filter frame 304 and fixed in the filter frame 304 to remove an odor component contained in the air that flows in through the suction grill 310.

A lower grill 330 is integrally formed in a lower half of the rear frame 300. The lower grill 330 allows air to be sucked into the air conditioner, and simultaneously, prevents inflow of foreign substances from the outside.

Knobs 340 are further provided to the rear frame 300. That is, knob holes 342 are formed in upper left and right sides of the rear frame 300 to pass through the rear frame 300, respectively. The knobs 340 are inserted into the knob holes 342. The knobs 340 are intended for allowing a user to easily lift and move the air conditioner.

In more detail, the knobs 340 are detachably and symmetrically installed in both sides of the rear frame 300. Therefore, a user can easily move the air conditioner by grabbing the knobs 340 with his both hands.

An exhaust guide element 400 is connected to the rear frame 300. The exhaust guide element 400 is intended for exhausting air that has been heat-exchanged in an inside of the air conditioner to an outdoor space. One end of the exhaust guide element 400 is connected to the rear frame 300, and the other end of the exhaust guide element 400 is preferably installed to be exposed to the outside of a building.

The exhaust guide element 400 is installed to communicate with an inside of the lower half of the rear frame 300, and includes an exhaust duct 410, an exhaust nozzle 420, a frame connector 430, and a nozzle connector 440.

The exhaust duct 410 is formed in a long cylinder-shaped tube to guide flowing of exhaust air, and the exhaust nozzle 420 is an end allowing exhaust air flowing through the exhaust duct 410 to be finally exhausted. The exhaust duct 410 is preferably formed of a flexible material or shape so that it can be bent. Also, the frame connector 430 is provided between the rear frame 300 and the exhaust duct 410 to allow a lower end of the exhaust duct 410 to be mounted in the rear frame 300. The nozzle connector 440 is provided between the exhaust duct 410 and the exhaust nozzle 420 to allow the exhaust nozzle 420 to be coupled to an upper end of the exhaust duct 410.

A lower appearance of the air conditioner is formed by a base pan 500. The base pan 500 is coupled to lower ends of the front and rear frames 100 and 300, and supports a plurality of parts. The base pan 500 has a quadrangular flat plate shape.

A plurality of moving wheels 502 are installed on a lower surface of the base pan 500. Each of the moving wheels 502 is intended for easily moving the air conditioner, and installed at each corner of the quadrangle-shaped base pan 500.

A first heat exchanger 510 is installed on an upper central portion of the base pan 500. That is, the first heat exchanger 510 is installed on the upper central portion of the base pan 500 that ranges from a rear side to a front side. The first heat exchanger 510 cools down (or heat) coolant using heat exchange between coolant flowing through the first heat exchanger 510 and air. That is, air that flows in through the lower grill 330 formed in the lower half of the rear frame 300 exchanges heat with coolant flowing through the first heat exchanger 510 while it passes through the first heat exchanger 510. The air that has been heat-exchanged while it passes through the first heat exchanger 510 is exhausted to an outdoor space through the exhaust guide element 400.

A compressor 520 is installed to the right side of the first heat exchange 510. The compressor 520 is installed at a rear right end of the base pan 500, and supported by a triangle-shaped compression frame 522. The compression frame 522 is mounted on the base pan 500.

An accumulator 530 is installed next to the compressor 520. The accumulator 530 filters liquid coolant to allow only gas coolant to flow into the compressor 520.

A condensed water detector 540 is installed in front of the compressor 520. When an amount of condensed water formed on an upper surface of the base pan 500 reaches a predetermined amount or more, the condensed water detector 540 detects the amount of condensed water and displays the detected condensed water to the outside.

A condensed water pump 550 is installed at a front right end of the base pan 500. The condensed water pump 550 pumps the condensed water formed on the base pan 500 to supply the condensed water to a sub-drain pan 750.

A condensed water pipe 560 is connected to the condensed water pump 550.

The condensed water pipe 560 serves as a passage for guiding condensed water forcibly flowed by the condensed water pump 550 to a sub-drain pan 750. Therefore, a lower end of the condensed water pipe 560 is connected to the condensed water pump 550, and an upper end of the condensed water pipe 560 is connected to the sub-drain pan 750.

A brace 570 is installed at a right end of the base pan 500. The brace 570 supports a right end of a main drain pan 700, which will be described later, and simultaneously, prevents the compressor 520 from falling down to the right. The brace 570 has a quadrangle-shaped flat plate. The brace 570 has a lower end fixed to an upper right end of the base pan 500, and has an upper end fixed to a right end of the main drain pan 700.

Also, a support angle 580 can be installed at a front end of the base pan 500. That is, the support angle 580 is vertically installed at a front right end of the base pan 500 to support a front load of the main drain pan 700. Of course, a pair of support angles 580 can be installed at left and right of a front end of the main drain pan 700.

A lower orifice 600 is installed at a left side of the first heat exchanger 510. The lower orifice 600 supports a plurality of parts such as an upper orifice 850 and an upper air guide 800, and simultaneously, guides air that has passed through the first heat exchanger 510 to the left. For this purpose, a circular lower orifice hole 602 is formed in a central portion of the lower orifice 600 to pass through the lower orifice 600. A lower air guide 620 is installed on the left side of the lower orifice 600. The lower air guide 620 guides air flowing in cooperation with the lower orifice 600. A lower fan 630 for forcing air flowing is located between the lower orifice 600 and the lower air guide 620. For this purpose, housing grooves 640 are symmetrically formed in the lower orifice 600 and the lower air guide 620 to guide air flowed by a lower fan 630.

That is, the housing grooves 640 symmetric with each other are formed in a left side of the lower orifice 600 and a right side of the lower air guide 620 to guide air discharged by the lower fan 630. The housing grooves 640 are formed to have a greater diameter than an outer diameter of the lower fan 630 to surround the lower fan 630.

Exhaust guides 650 having shapes symmetric with respect to each other are formed at rear ends of the lower orifice 600 and the lower air guide 620. The exhaust guides 650 guide air guided by the housing grooves 640 to the exhaust guide element 400. Upper ends of the exhaust guides 650 constitute a shape corresponding to that of a lower end of the exhaust guide element 400.

A circular exhaust grill 652 is inserted and mounted in an upper inner end of the exhaust guides 650. The exhaust grill 652 prevents external foreign substances from being inserted to a lower portion of the exhaust guides 650.

A lower motor hole 622 is formed in a central portion of the lower air guide 620 to pass through the lower air guide 620. Therefore, a lower motor 660 is inserted to pass through the lower motor hole 622 so that it is fixedly installed therein. The lower motor 660 generates rotational power using power supplied from the outside and provides the rotational power to the lower fan 630 to rotate the lower fan 630.

A lower motor support 670 is further provided to the right side of the lower air guide 620. The lower motor support 670 is intended for more solidly supporting the lower motor 660 mounted in the lower air guide 620. A lower end of the lower motor support contacts the base pan 500. The main drain pan 700 is installed on a central rear side of the front frame 100. The main drain pan 700 has a quadrangular shape as illustrated. The main drain pan 700 collects condensed water generated at a second heat exchanger 860 which will be described later, and simultaneously, supports a plurality of parts, and vertically divides an inner space of the air conditioner.

In more detail, an integral type is generally divided into an indoor side and an outdoor side. The main drain pan 700 divides the inside of the air conditioner into an indoor side and an outdoor side. That is, the outdoor side (a heat sink side) corresponding to an outdoor unit (in a separation type air conditioner) is formed below the main drain pan 700, and the indoor side (a heat absorbing side) corresponding to an indoor unit (in a separation type air conditioner) is formed above the main drain pan 700.

A sub-drain pan 750 is installed under the main drain pan 700. The sub-drain pan 750 collects and dispenses condensed water supplied by the main drain pan 700 and the condensed water pump 550.

In detail, the sub-drain pan 750 is formed long over a back and forth portion, and installed on an upper side of the first heat exchanger. Therefore, condensed water formed on the main drain pan 700 falls down to the sub-drain pan 750 and is collected. Also, condensed water formed on the base pan 500 is supplied to the sub-drain pan 750 via the condensed water pipe 560. The condensed water supplied to the sub-drain pan 750 is uniformly sprayed on an upper end of the first heat exchanger 510 and evaporated.

An upper air guide 800 is installed on an upper side of the main drain pan 700. The upper air guide 800 is installed to across left and right of an upper side of the main drain pan 700 to guide air flowed by an upper fan 840. An upper fan housing 810 is integrally formed with the upper air housing 800. The upper fan housing 810 is installed to surround an outer side of the upper fan 840. Therefore, air forcibly discharged by the upper fan 840 is guided by the upper fan housing 810 to flow to a discharge guide opening 814. An upper motor hole 812 is formed in a central portion of the upper air guide 800 to pass through the upper air guide 800. An upper motor 820 is inserted into the upper motor hole 812 to provide rotational power to the upper fan 840.

The discharge guide opening 814 is formed in an upper end of the upper air guide 800 to pass through the upper air guide 800. The discharge guide opening 814 has a rectangular shape corresponding to a shape of the discharge louver 110. Therefore, air guided by the upper fan housing 810 flows to the front via the discharge guide opening 814 to pass through the discharge louver 110.

An upper motor support 830 is further provided on a lower side of the upper motor 820. The upper motor support 830 performs the same function as that of the lower motor support 670. That is, the upper motor support 830 in intended for more solidly supporting the upper motor 820. For this purpose, a lower end of the upper motor support 830 is fixedly mounted on a front upper surface of the main drain pan 700.

The upper fan 840 is received inside the upper fan housing 810. The upper fan 840 forces external air to flow via the suction grill 310. The upper fan 840 is coupled at a rear end of the upper motor 820 to rotate.

An upper orifice 850 is provided on a rear side of the upper air guide 800. The upper orifice 850 is formed in a quadrangular flat plate. A circular upper orifice hole 852 is formed in a central portion of the upper orifice 850 to pass through the upper orifice 850 so that air can flow through the upper orifice hole 852.

The second heat exchanger 860 is installed horizontally long in a rear portion behind the main drain pan 700 to allow air sucked via the suction grill 310 to exchange heat with coolant flowing through the second heat exchanger 860.

Meanwhile, a control box 870 is installed at a front right end of the main drain pan 700. The control box 870 mounts a plurality of electric components controlling an operation of the air conditioner therein. The control box 870 is installed to pass through the main drain pan 700. That is, an upper half of the control box 870 protrudes above the main drain pan 700, and a lower half of the control box 870 protrudes below the main drain pan 700.

Figure 4:
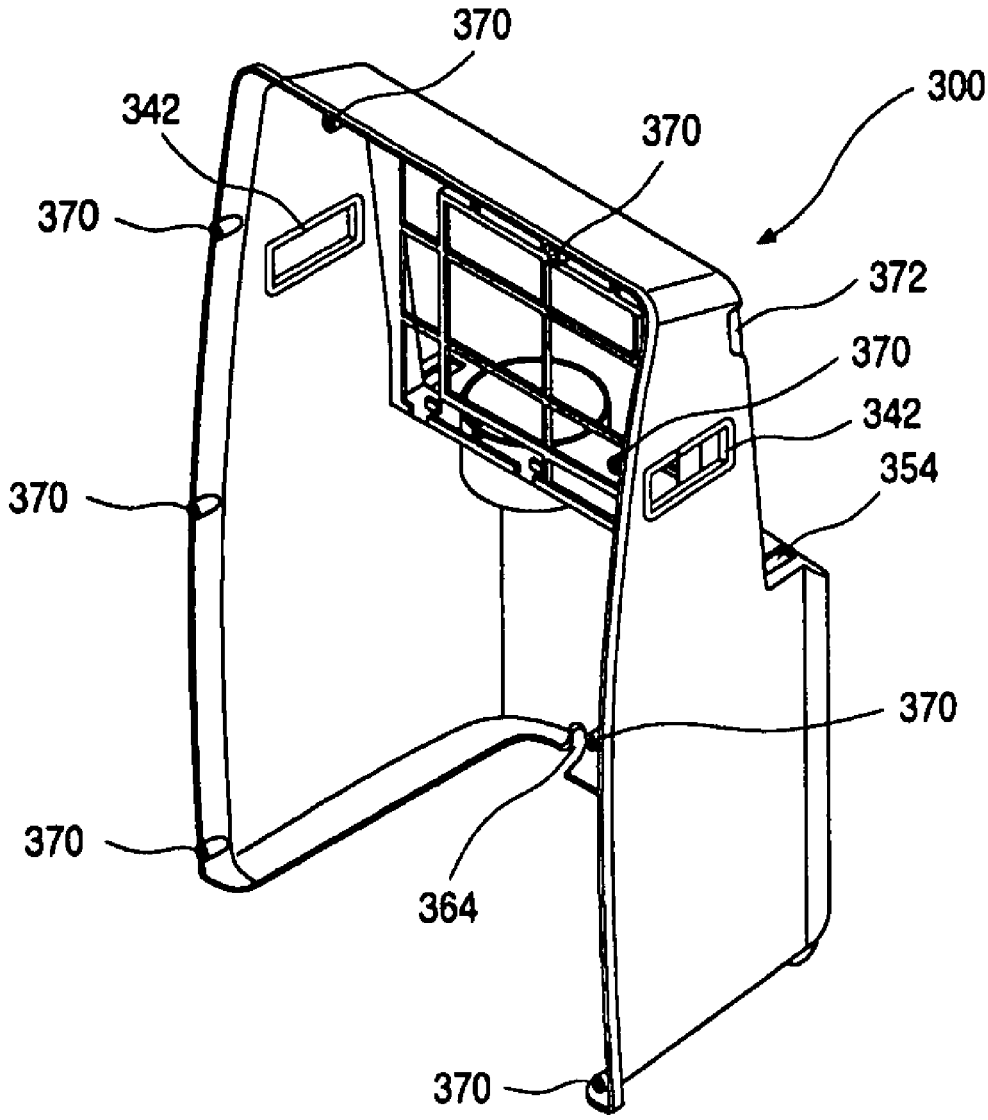
FIGS. 4 and 5 are front and rear perspective views showing a detailed construction of a rear frame according to an embodiment of the present invention.
Figure 5:
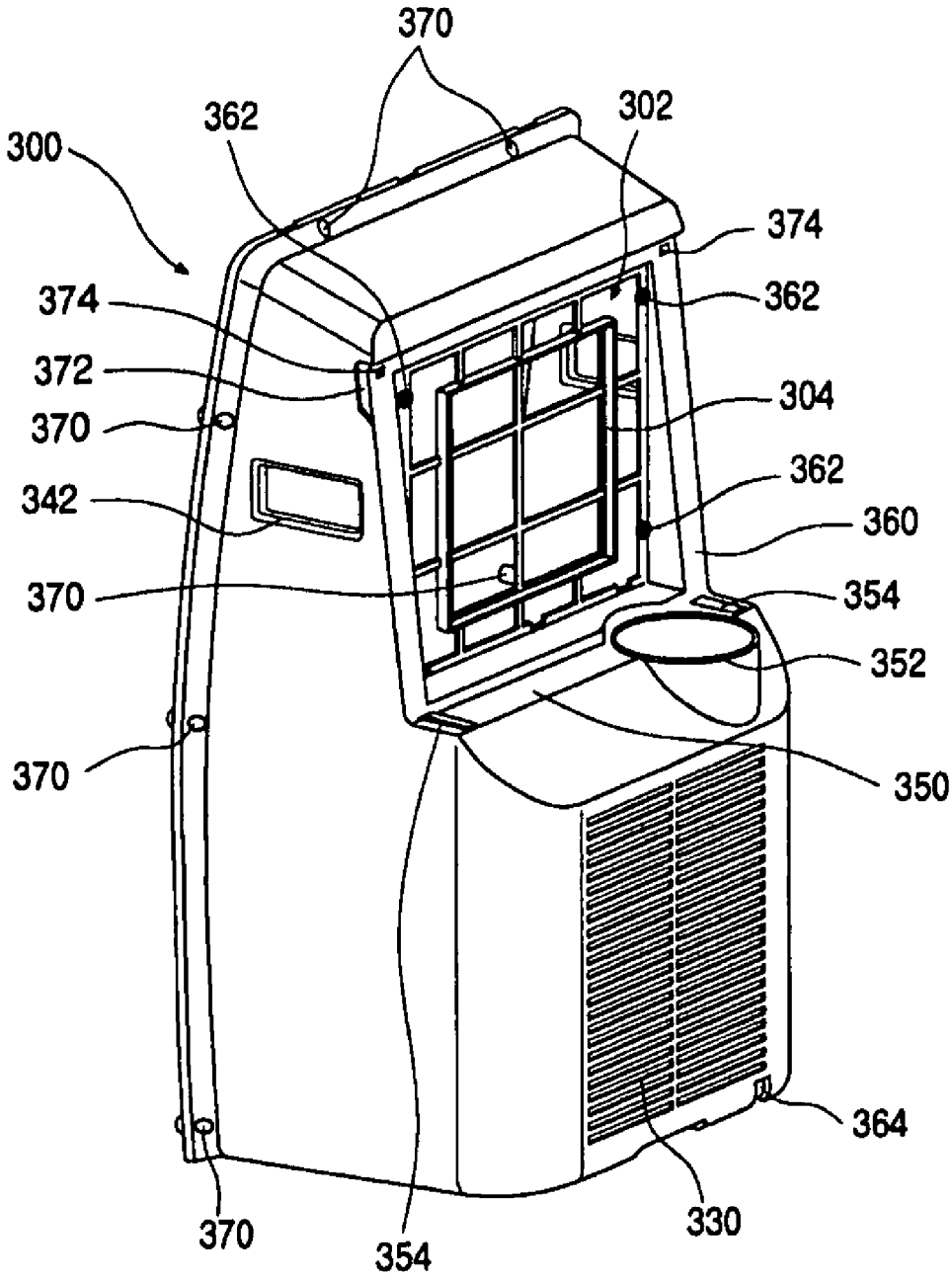

FIGS. 4 and 5 are a front perspective view and a rear perspective view of the frame 300. A construction of the rear frame 300 will be described in more detail with reference to FIGS. 4 and 5.

A rear side of the rear frame 300 is formed to have a height difference. In detail, back and forth lengths of an upper half and a lower half of the rear frame 300 are different from each other. That is, the back and forth length of the upper half of the rear frame 300 is greater than that of the lower half of the rear frame 300. Therefore, a height difference surface 350 is formed at a central portion of the rear frame 300. That is, the height difference surface 350 formed horizontally is provided below the external air inlet 302 formed in the upper half of the rear frame 300 to pass through the rear frame 300.

Also, a duct connecting hole 352 is formed in the height difference surface 350 to vertically pass through the height difference surface 350. The duct connecting hole 352 is a portion to which a lower end of the exhaust guide element 400 is coupled. That is, the frame connector 430 constituting the exhaust guide element 400 is inserted into the duct connecting hole 325. Therefore, the duct connecting hole 352 is formed in a cylindrical shape having a size and a shape corresponding to a lower end of the frame connector 430.

A grill projection receiving hole 354 is formed in left and right ends of the height difference surface 350 to vertically pass through the height difference surface 350.

A grill projection receiving hole 354 receives a grill coupling projection 317 of the suction grill 310.

Meanwhile, a grill mounting part 360 is formed on an upper side of the height difference surface 350. The grill mounting part 360 is a portion on which the suction grill 310 is mounted, and is formed on a rear side of the external air inlet 302.

Also, a plurality of filter fixing hooks 362 are formed along edges of the external air inlet 302 to mount the pre-filter 320 thereon. That is, the filter fixing hooks 362 having a hook shape and protruding to a rear side are formed at four corners along rear edges of the external air inlet 302, respectively, to fix four corners of the pre-filter 320.

Also, the lower grill 330 is formed below the height difference surface 350. The lower grill 330 is preferably formed only in a right portion of the lower half of the rear frame 300. That is, though the lower grill 310 is formed over an entire portion of the lower half of the rear frame 300 in FIG. 5, the lower grill 300 is formed for compatibility in this case. Actually, air can flow through only a right portion (a left portion in FIG. 5), and cannot flow through a left portion (a right portion in FIG. 5) because an inner side of the left portion is shielded.

The reason the lower grill 330 is formed in only the right portion of the rear frame 300 is to allow air sucked through the lower grill 330 to pass through the first heat exchanger 510. That is, the lower grill 330 is formed in only the right portion of the rear frame 300 to allow the air sucked from a rear side through the lower grill 330 to flow to the right of the first heat exchanger 510, pass through the first heat exchanger 510, and move the left of the first heat exchanger 510.

A piping hole 364 is formed in a lower end of the rear frame 300 to pass through the rear frame 300 in a back and forth direction. The piping hole 364 is a portion in which a draining pipe (not shown) is formed. The draining pipe allows condensed water to be drained.

A plurality of frame coupling projections 370 for coupling to the front frame 100 are formed along a front end of the rear frame 300. The frame coupling projections 370 are portions into which coupling members such as screws are inserted. The frame coupling projections 370 are formed at central portions of left and right front ends, an upper end, and a lower end of the rear frame 300, and left and right of an upper front side of the rear frame 300. Therefore, when screws are inserted into the frame coupling projections 370 and coupled to the front frame 100, coupling of the front and rear frames 100 and 300 is performed.

Meanwhile, a detachment groove 372 is formed in a rear end of a lateral upper end of the rear frame 300. The detachment groove 372 is formed to be recessed a predetermined distance from both sides of the rear frame 300 to an inner side. The detachment groove 372 preferably has a vertical length corresponding to a human hand.

The detachment groove 372 is intended for preventing interference with a user's hands when the user grabs a detachment rib 315 in order to pull the detachment rib 315 of the suction grill 310 to the front.

Grill hook coupling holes 374 are formed in a rear upper end of the rear frame 300 to pass through the rear frame 300. The grill hook coupling holes 374 are portions into which grill coupling hooks 316 are inserted and coupled. The grill hook coupling holes 374 are formed to have a size corresponding to that of a front end of the grill coupling hook 316.

In more detail, the grill hook coupling holes 374 passing through in a back and forth direction are formed in upper left and right ends of the grill mounting part 360. The grill hook coupling holes 374 have a size through which a hooking part 316' of the grill coupling hook 316 can pass.

Figure 6:
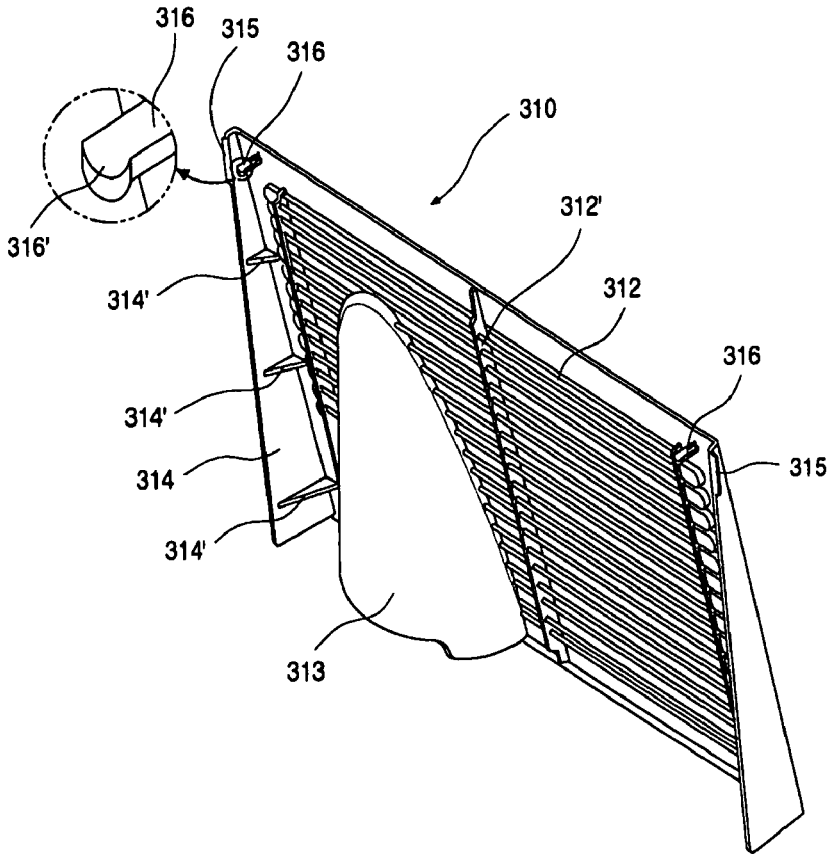
FIGS. 6 and 7 are front and rear perspective views illustrating a detailed construction of a suction grill according to an embodiment of the present invention.
Figure 7:
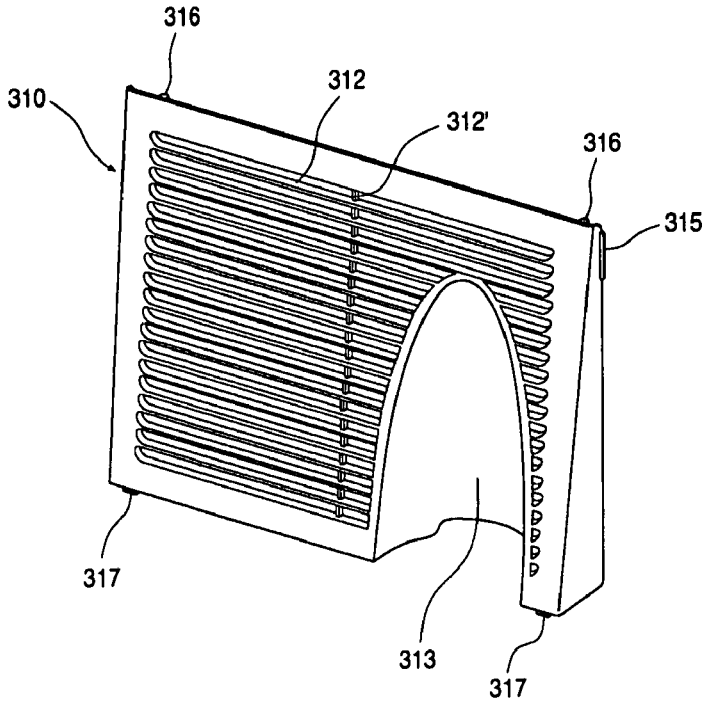

FIGS. 6 and 7 are front and rear perspective views of the suction grill 310, respectively. Referring to FIGS. 6 and 7, a plurality of grill ribs 312 are formed with an equal interval on the suction grill 310. Therefore, air is sucked through gaps between the plurality of grill ribs 312.

Also, the gaps between the plurality of grill ribs 312 are preferably shielded using a mesh network or a gauze. This is for preventing external foreign substances from passing through the grill ribs 312.

A rib support 312' is vertically formed at a central portion of the suction grill 310. The rib support 312' supports the plurality of grill ribs 312. A duct receiving groove 313 is formed in the suction grill 310 to receive a portion of the exhaust guide element 400. That is, the duct receiving groove 313 collapsing to the front (in FIG. 6) is formed in a left portion of the suction grill 310. A lower end of the duct receiving groove 313 has a semicircular groove shape corresponding to a front side of the exhaust duct 410. Therefore, front ends of the exhaust duct 410 and the frame connector 430 are received in the duct receiving groove 313.

The suction grill 310 is sloppily formed to have a predetermined slope toward the front. Therefore, both ends of the suction grill 310 are bent to the front and extended to form grill lateral sides 314 of a triangular shape whose width increases toward a lower end. Also, a plurality of grill reinforcing ribs 314' are formed on an inner surface of the grill lateral sides 314 to reinforce support strength.

The detachment ribs 315 are formed at upper ends of the suction grill 310 to allow a user to detach the suction grill 310. In more detail, the detachment ribs 315 protruding with a predetermined size in a lateral direction are formed at upper ends of the grill lateral sides 314. Therefore, when a user grabs the detachment ribs 315 and pulls the detachment ribs 315 in a rear direction, an upper end of the suction grill 310 is separated from the rear frame 300.

A pair of grill coupling hooks 316 is formed at upper ends of the suction grill 310. The grill coupling hooks 316 protrude to the front from left and right upper ends of the suction grill 310 to allow the upper end of the suction grill 310 to be coupled to the rear frame 300.

The grill coupling hooks 316 are formed to have elasticity of its own such that their front ends moves and restores a predetermined distance vertically and horizontally. The hooking parts 316' having a relatively greater cross-section than that of a rear portion is formed at the front ends.

Therefore, after the grill coupling hooks 316 are inserted into the grill hook coupling holes 374 of the rear frame 300, the grill coupling hooks 316 are not detached from the grill hook coupling holes 374 because of the hooking part 316' of the grill coupling hook 316 unless force of predetermined intensity is applied.

The grill coupling projections 317 are formed at lower ends of the suction grill 310. The grill coupling projections 317 are portions inserted into the grill projection receiving holes 354. Therefore, the grill coupling projections 317 are formed to protrude in a predetermined size from left and right lower ends of the suction grill 310 to a lower direction, and have a horizontal size corresponding to a width of the grill projection receiving holes 354.

Figure 8:
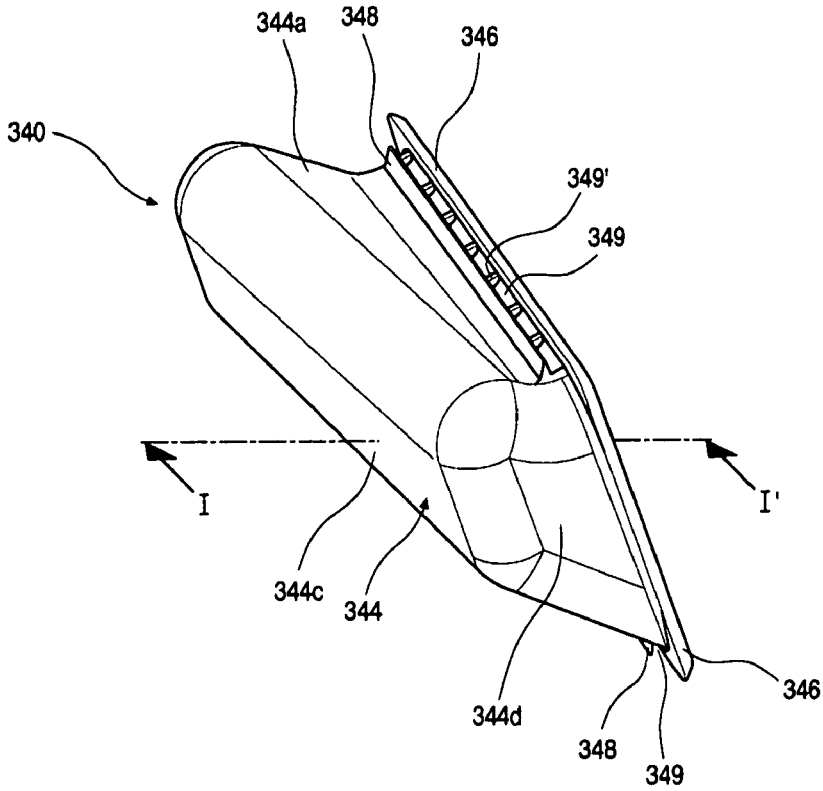
FIGS. 8 and 9 are perspective views illustrating constructions of a right knob and a left knob according to an embodiment of the present invention.
Figure 9:
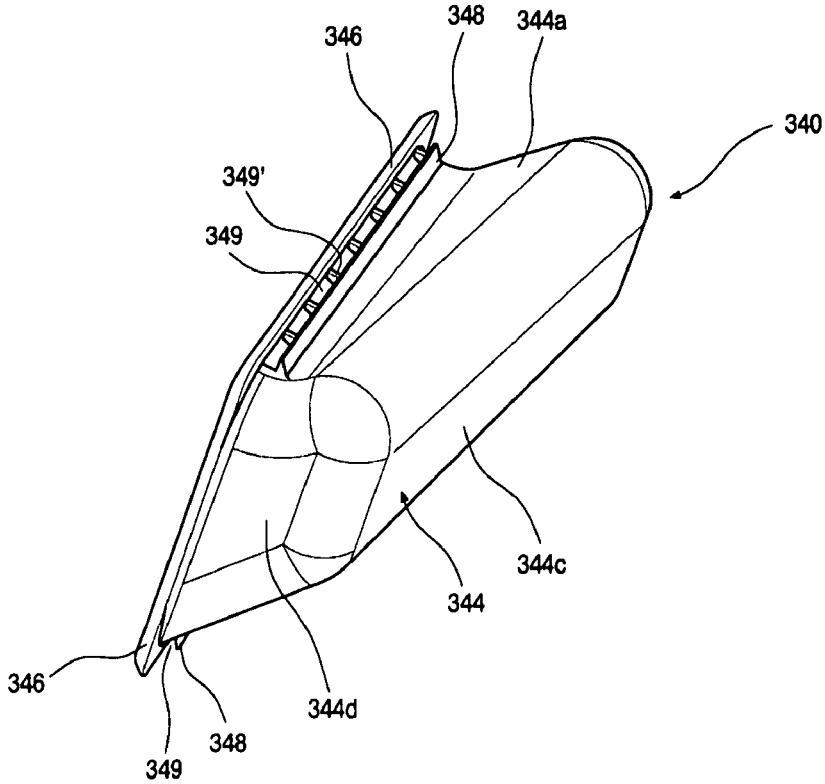
Figure 10:
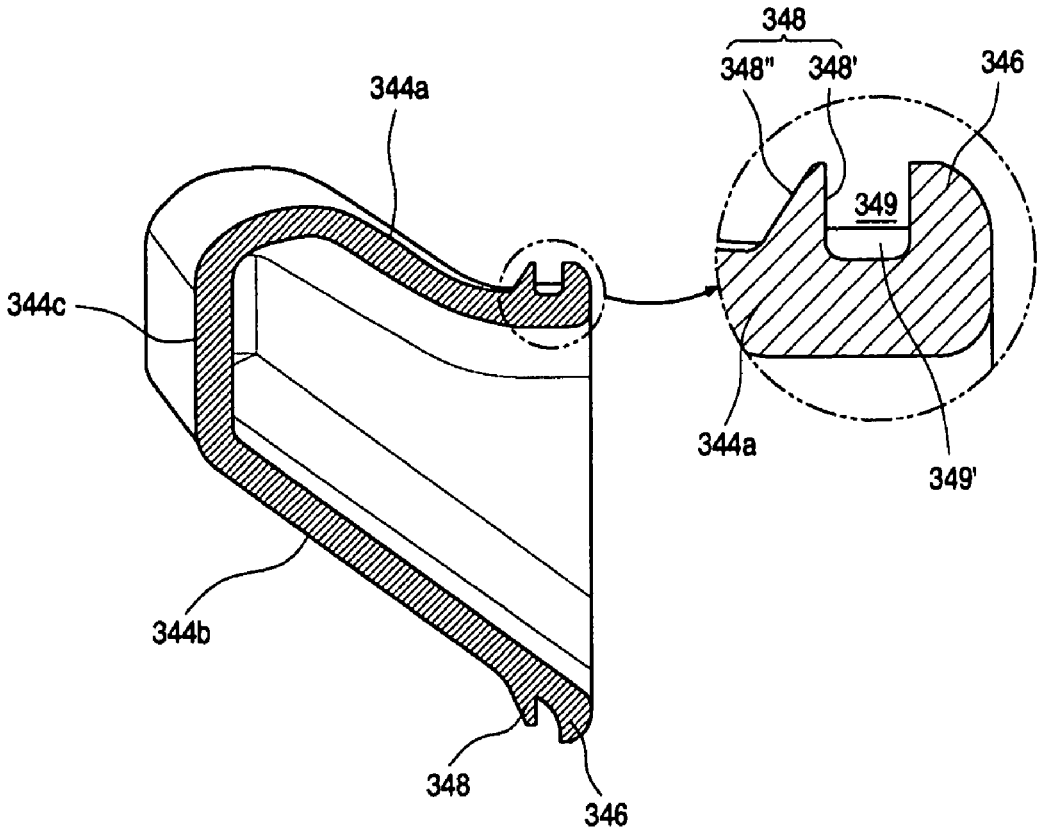
FIG. 10 is a cross-sectional view taken along line I-I' in FIG. 8.
Figure 11:
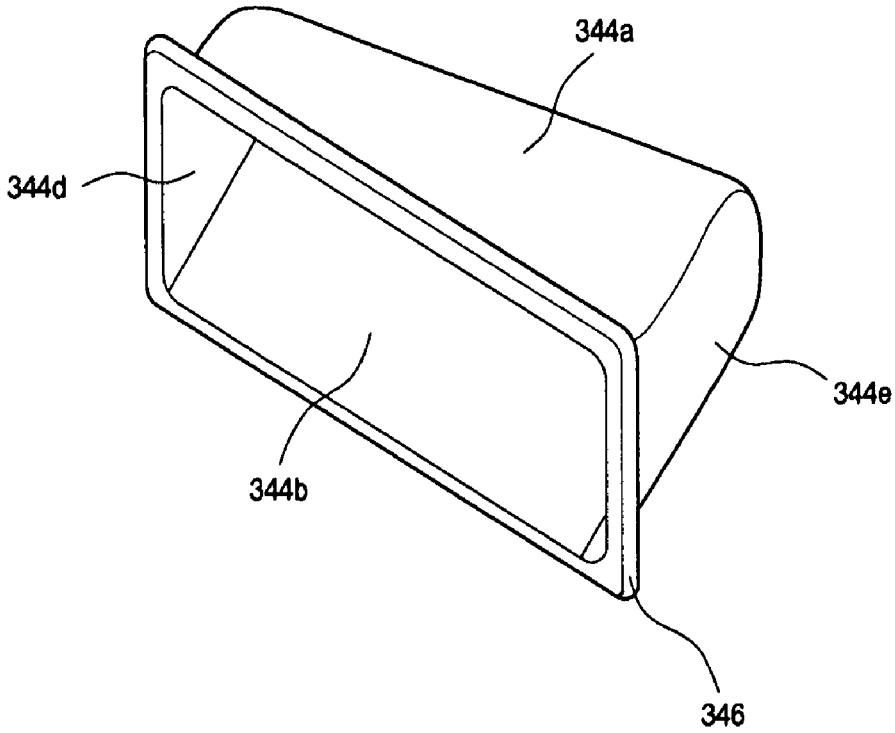
FIG. 11 is a perspective view illustrating a right side construction of the knob illustrated in FIG. 8.

FIGS. 8 to 11 illustrate in more detail a construction of the knob 340. That is, FIG. 8 is a perspective view of a knob of a pair of knobs 340 that is installed on a right side of the rear frame 300, and FIG. 9 is a perspective view of a knob that is installed on a left side of the rear frame 300. Also, FIG. 10 is a cross-sectional view taken along a line I-I' of FIG. 8, and FIG. 11 is a perspective view illustrating a right side of the knob illustrated in FIG. 8.

A construction of the knob 340 will be described below with reference to the accompanying drawings. Also, since the knobs 340 on both sides (FIGS. 8 and 9) have shapes symmetric with respect to each other, descriptions will be made with reference to FIGS. 8, 10, and 11 illustrating the knob on the right side.

As illustrated, the knob 340 includes a knob body 344 for receiving a user's fingers, a knob edge 346 protruding along an edge of the knob body 344, and a fixing rib 348 formed on a location spaced a predetermined distance from the knob edge 346.

The knob body 344 is a portion into which a user's fingers are inserted, and is formed in an about '⊏'shape so that a predetermined space is formed inside the knob body 344. Therefore, four fingers except a thumb are inserted into this inner space.

The knob body 344 includes a knob upper surface 344*a* constituting an upper appearance, a knob lower surface 344*b* formed at a location separated a predetermined distance from the knob upper surface 344*a* to constitute a lower appearance, a knob lateral surface 344*c* connecting the knob upper surface 344*a* with the knob lower surface 344*b* and simultaneously constituting a lateral appearance, and a knob front surface 344*d* and a knob rear surface 344*e* constituting a front appearance and a rear appearance, respectively.

The knob edge 346 protrudes in a predetermined size to an outer side in back and forth direction and a horizontal direction along an edge of a right end of the knob body 344 having an about rectangular shape. Therefore, the knob edge 346 contacts an outer surface of the rear frame 300 when the knob 340 is mounted in the knob hole 342 of the rear frame 300.

The fixing rib 348 is formed long in a back and forth direction on an upper surface and a lower surface of the knob 340. The fixing rib 348 is formed in a location separated a predetermined distance from the knob edge 346. Therefore, the fixing rib 348 is located inside the rear frame when the knob 340 is mounted in the knob hole 342.

In more detail, referring to FIG. 10, the fixing rib 348 has a triangle-shaped cross-section (when seen from a front side). In other words, a right surface and a left surface of the fixing rib 348 include a vertical surface 348' and a guide surface 348". The vertical surface 348' contacts an inner surface of the rear frame 300, and the guide surface 348" guides mounting of the knob 340. That is, the guide surface 348" is formed to have an acute angle with the vertical surface 348' to allow the knob 340 to slide on an edge of the knob hole 342 and pass through the knob hole 342 when the knob 340 is inserted into the knob hole 342 from a side direction. A knob groove 349 is formed between the knob edge 346 and the fixing rib 348 spaced from each other. Therefore, a lateral side of the rear frame 300 is inserted into this knob groove 349.

The knob groove 349 is formed in an U-shape (when seen from a front side). A plurality of knob reinforcing ribs 349' are arranged with a predetermined interval on a lower surface of the knob groove 349 to more solidly support the fixing rib 348.

Meanwhile, the knob body 344 is formed such that its horizontal width gradually decreases toward the front side.

When the knob body 344 is formed such that its horizontal width gradually decreases toward the front side, a user can easily grab the knob 340. That is, such a shape of the knob 340 is formed with consideration of a difference in respective human fingers.

For example, in the case where the air conditioner of the present invention is raised by a user from the front direction, an index finger (a second finger) of the user is received in an inner rear end of the knob body 344, and a little finger is positioned at an inner front end of the knob body 344. Therefore, for swift receiving the index finger, a width of a rear end of the knob body 344 is made wider than that of a front end of the knob body 344.

Also, the knob body 344 has a shape that is gradually inclined upward as it is distant from the knob edge 346. That is, in FIG. 10, a left end of the knob body 344 is located in a higher position that that of a right end of the knob body 344. Such a shape is for preventing a user's hand from being easily detached from the inside of the knob body 344 once inserted into the knob body 344. In more detail, the pair of left and right knob bodies 344 has a shape that is inclined upward as it reaches a central portion of the air conditioner. Therefore, referring to FIG. 10, each of the knob upper surface 344*a* and the knob lower surface 344*b* is an inclined surface. That is, each of the knob upper surface 344*a* and the knob lower surface 344*b* becomes higher in position as it goes to the left side.

Figure 12:
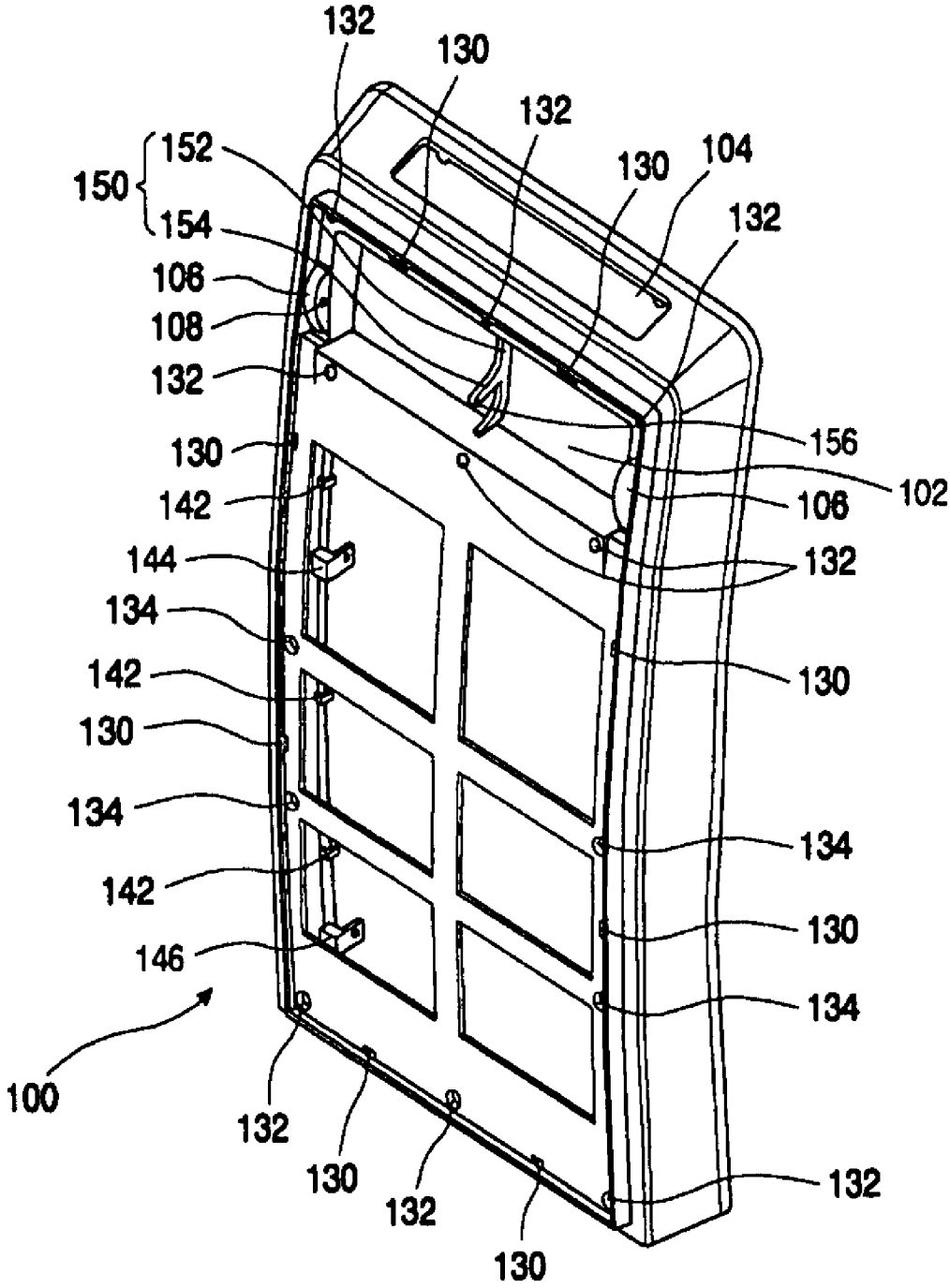
FIGS. 12 and 13 are front and rear perspective views of a front frame according to an embodiment of the present invention.
Figure 13:
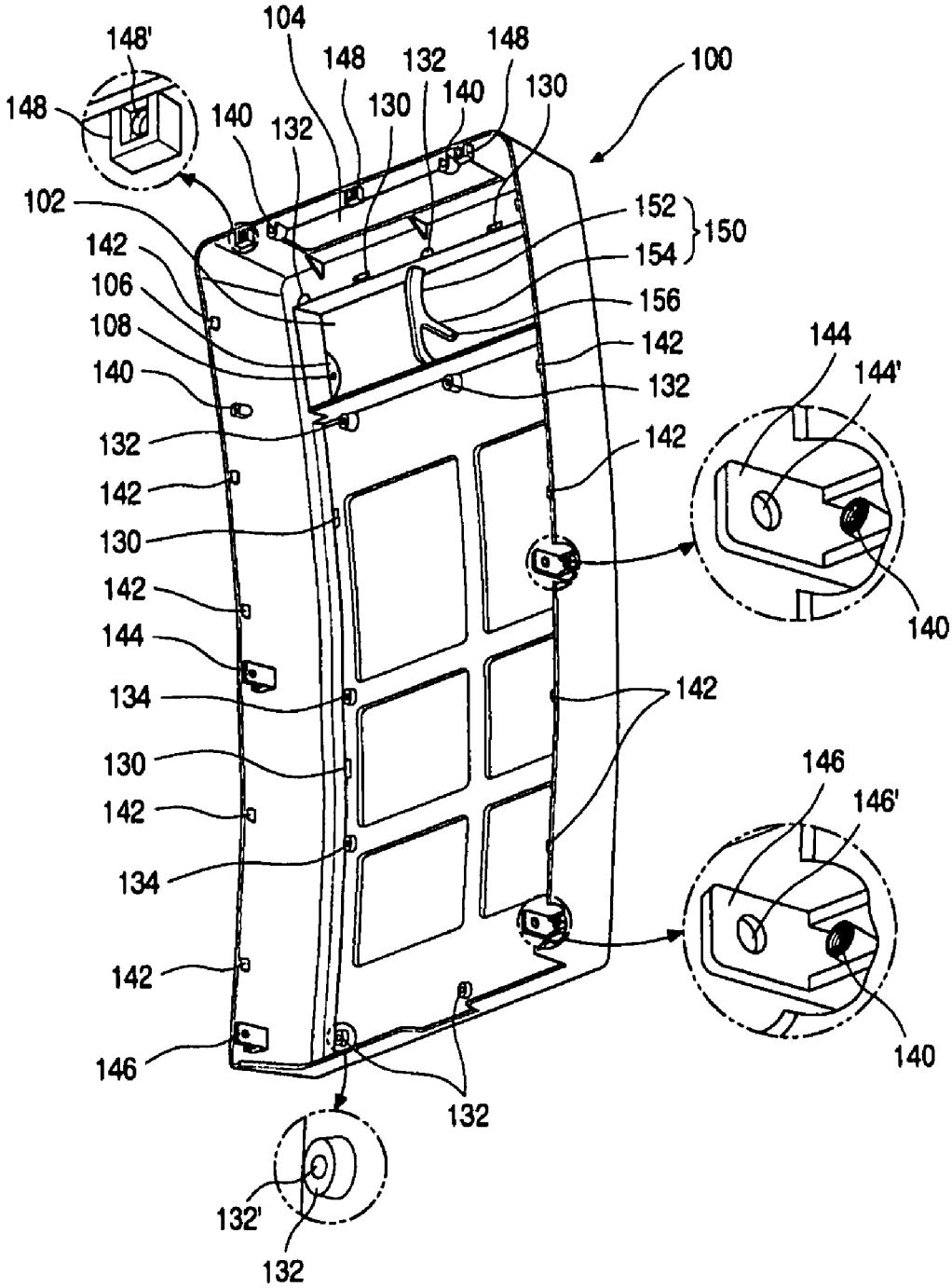

FIGS. 12 and 13 are a front perspective view and a rear perspective view of the front frame 100, respectively.

Referring to FIGS. 12 and 13, the front frame 100 is formed in a grating shape and includes a plurality of quadrangular openings. Also, though not shown, a reinforcing panel can be installed on a rear side of the front frame 100 in which the plurality of openings are formed. The reinforcing panel performs a soundproofing function and a sound-absorbing function for absorbing or blocking noises generated from an inside of the air conditioner, and is preferably formed of a material that can absorb water (e.g., condensed water) created from an inside of the air conditioner.

The front panel 200 is doubly fixedly installed on the front frame 100. That is, the front panel 200 is doubly fixed and mounted on the front frame 100 using a provisional assembling element and a fixing element.

The provisional assembling element allows the front panel 200 to be provisionally assembled to the front frame 100, and includes a plurality of panel hooks 220 and panel hook holes 130 which will be described below in detail Also, the fixing element allows the front panel 200 to be fixed on the front frame 100 using a coupling element, and includes panel coupling parts 132, a panel coupling projection 222, and a coupling member (e.g., screws).

In more detail, the plurality of panel hook holes 130 are formed in the front frame 100. The panel hook holes 130 are portions to which the plurality of panel hooks 220 of the front panel 200 are inserted and coupled. The plurality of panel hook holes 130 are formed along a front edge of the front frame 100.

Meanwhile, the panel coupling parts 132 are formed in the front frame 100. The panel coupling parts 132 are formed on an upper side and a lower end of the front frame 100. That is, three panel coupling parts 132 are formed on an upper end of the louver installation opening 102, and three panel coupling parts 132 are formed on a lower end of the louver installation opening 102 with a predetermined interval. Also, three panel coupling parts 132 are formed horizontally with a 31 predetermined interval on a lower end of the front frame 100. The panel coupling parts 132 are portions through which coupling members (not shown) such as screws pass. Therefore, panel coupling holes 132' are formed in central portions of the panel coupling parts 132 to allow the coupling members to be inserted into and pass through the panel coupling holes 132'.

Also, additional coupling parts 134 are further formed on the front frame 100. The additional coupling parts 134 are formed in the same shapes as those of the panel coupling parts 132, but forming positions of the additional coupling parts 134 are different. That is, the additional coupling parts 134 are preferably formed at central portions of the front frame 100. In more detail, two additional coupling parts 134 are formed at left and right of a lower half of the front frame 100.

The additional coupling parts 134 serve as additional coupling means together with additional coupling projections 224 of the front panel 200. The additional coupling means is selectively used depending on a weight of the front panel 200. That is, the additional coupling means is used to allow the front panel 200 to be more solidly fixed on the front frame 100 in the case where a heavy part such as a glass is further installed on a front side of the front panel 200.

Therefore, a coupling member such as the panel coupling parts 132 passes through the additional coupling parts 134.

A plurality of frame coupling parts 140 are formed on lateral sides and an upper rear end of the front frame 100. The frame coupling parts 140 are portions to which coupling members (not shown) such as screws are coupled, and are formed at positions corresponding to the frame coupling projections 370 of the rear frame 300. Therefore, when the coupling members pass through the frame coupling projections 370 and couple to the frame coupling parts 140, the rear frame 300 and the front frame 100 are coupled to each other. Screw grooves to which coupling members such as screws are coupled are formed in central portions of the plurality of frame coupling parts 140.

A plurality of coupling guide ribs 142 protrude inward from a lateral rear end of the front frame 100. The coupling guide rib 142 is intended for guiding assembling of the front frame 100 and the rear frame 300, and is formed in a '⌐'or '¬'shape (when seen from an upper side). Therefore, an edge of the rear frame 300 is inserted into a gap between the coupling guide rib 142 and the front frame 100.

A pair of drain coupling members 144 protrude inward from a lateral side of the front frame 100. The drain coupling members 144 protrude inward from both lateral sides of the front frame 100 to be symmetric with each other, and are formed in a '⌐'or '¬'shape (when seen from an upper side).

The drain coupling members 144 allow the front frame 100 to be coupled to the main drain pan 700 using a coupling member. Therefore, a drain coupling hole 144' is formed in a rear end of the drain coupling member 144 to pass through the drain coupling member 144 so that a coupling member such as a screw passes through the drain coupling hole 144'.

Also, referring to FIG. 13, the frame coupling parts 140 are integrally formed with an inside of the drain coupling members 144.

A pair of base coupling members 146 protrude inward from a lateral lower end of the front frame 100. The base coupling members 146 protrude inward from both sides of the front frame 100 to be symmetric with respect to each other, and are formed in a '⌐'or '¬'shape (when seen from an upper side) as in the drain coupling members 144.

The base coupling members 146 are intended for allowing the front frame 100 and the base pan 500 to be coupled to each other using a coupling member such as a screw. Therefore, a base coupling member 146' is formed in a rear end of the base coupling member 146 to pass through the base coupling member 146 so that a coupling member such as a screw passes through the base coupling member 146'.

Also, the frame coupling part 140 is integrally formed with an inside of the base coupling member 146 as in the inside of the drain coupling member 144.

A plurality of air guide coupling members 148 are formed at an upper rear end of the front frame 100. The air guide coupling members 148 are intended for the upper air guide 800 to be coupled to the front frame 100. Three air guide coupling members 148 are formed with a predetermined interval at a lower side of an upper rear end of the front frame 100. An air guide coupling hole 148' is formed in the air guide coupling members 148 to pass through the air guide coupling members 148 so that a coupling member such as a screw passes through the air guide coupling hole 148'.

Louver installation parts 106 are formed on both sides of the louver installation opening 102, respectively. The louver installation parts 106 are portions at which both ends of the discharge louver 110 is installed and supported, and are formed in a semicircle shape protruding to the front in a rounded shape.

Also, a louver installation groove 108 is recessed in a lateral direction from an inner lateral side of the louver installation part 106. A louver rotational shaft 111 of the discharge louver 110 is inserted into the louver installation groove 108. The louver installation groove 108 is formed in each of lateral sides of the pair of the louver installation parts 106. A front side of at least one of the two louver installation grooves 108 is preferably open to allow the louver rotational shaft 111 to be easily installed.

A louver motor (not shown) providing rotational power to the discharge louver 110 is installed inside at least one of the pair of the louver installation parts 106 formed at both ends of the louver installation opening 102.

A louver support 150 is integrally formed at a central portion of the louver installation opening 102. The louver support 150 is vertically formed to support a central portion of the discharge louver 110.

The louver support 150 includes a connection part 152 installed vertically across the louver installation opening 102, and a stopper 154 extending to the front from a central portion of the connection part 152. Also, an upper end and a lower end of the stopper 154 contact a groove front side 114' and a groove lower side 114" of the discharge louver 110 to limit a rotation range of the discharge louver 110.

A louver support hole 156 is formed in a front end of the stopper 154 to pass through the stopper 154. The louver support hole 156 is a portion into and by which a central support shaft 115 of the discharge louver 110 is inserted and supported.

Figure 14:
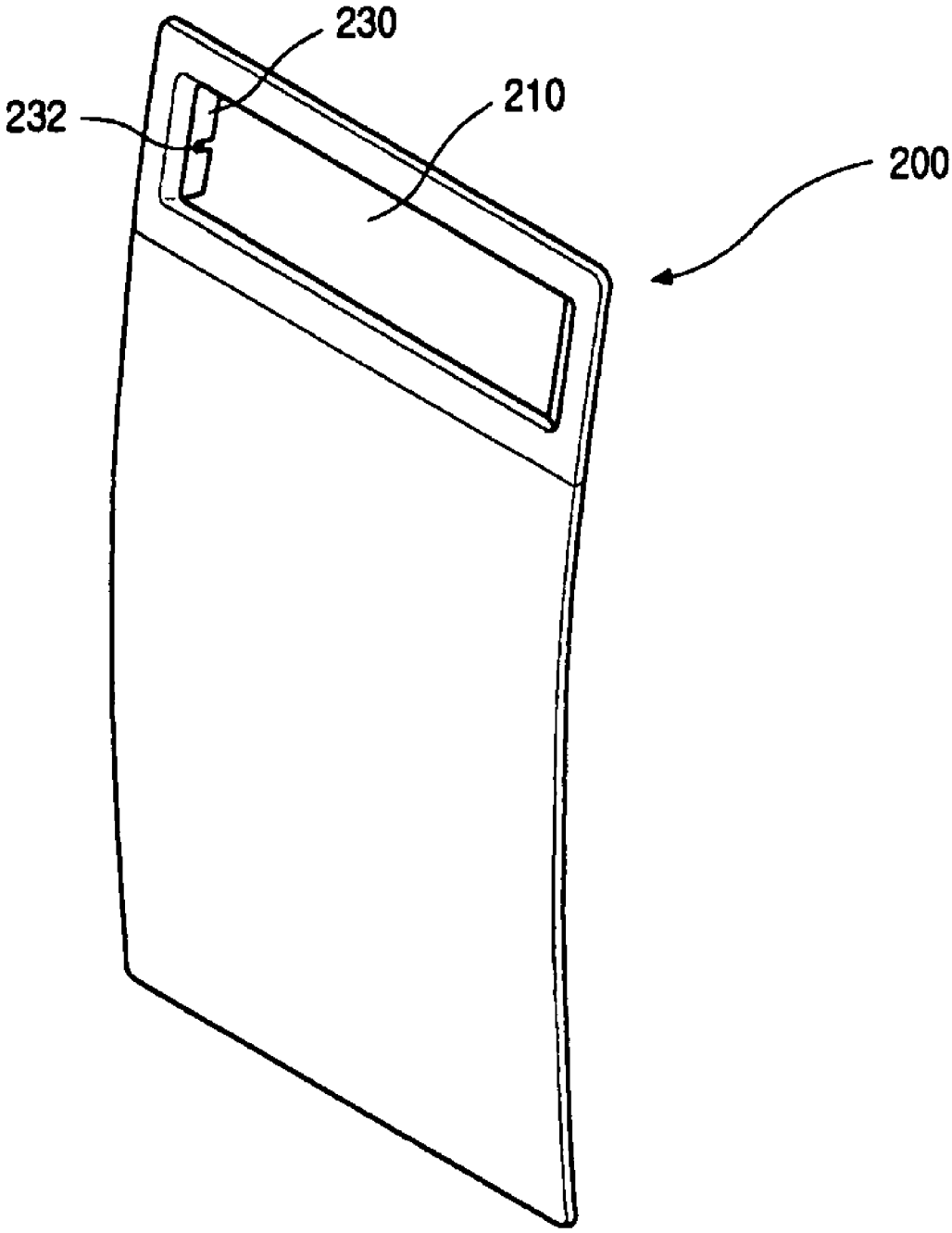
FIGS. 14 and 15 are front and rear perspective views of a front panel according to an embodiment of the present invention.
Figure 15:
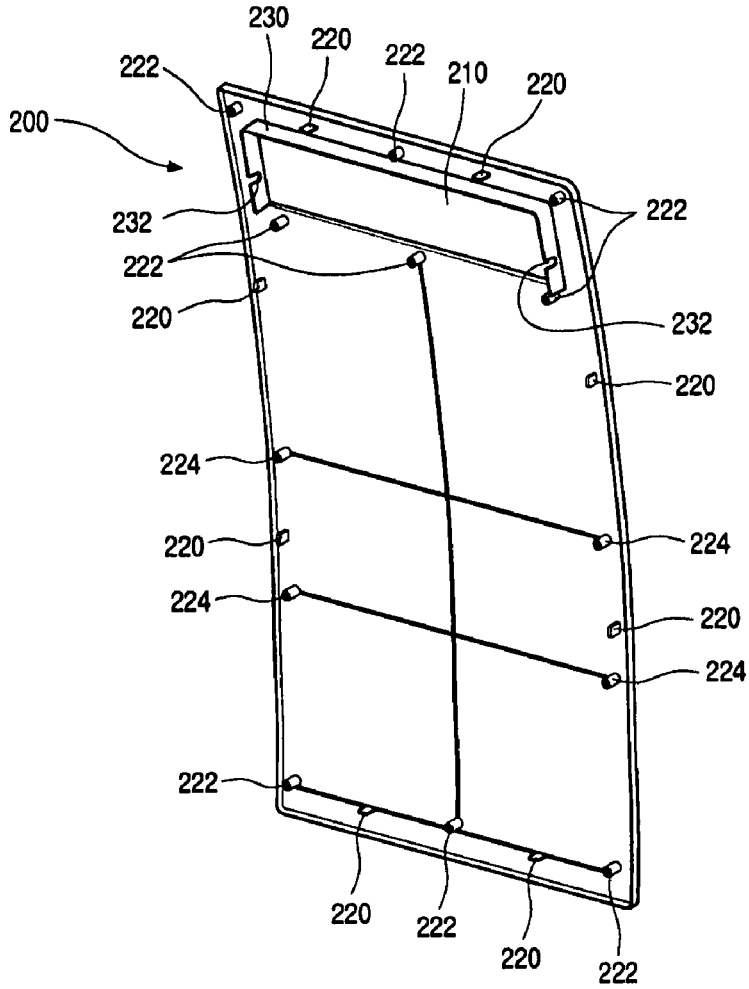

FIGS. 14 and 15 are a front perspective view and a rear perspective view of the front panel 200, respectively.

Referring to FIGS. 14 and 15, a plurality of panel hooks 220 protrude in a rear direction from a rear edge of the front panel 200. The panel hooks 220 have a shape corresponding to that of the plurality of panel hook holes 130 formed on the front frame 100, so that the panel hooks 220 are coupled to the panel hook holes 130. Therefore, a corresponding number of panel hooks 220 are formed on positions corresponding to positions where the panel hook holes 130 are formed, respectively. Also, the panel hooks 220 are formed in a '¬'shape (when seen from a lateral direction). That is, a front end of the panel hook 220 is formed to have a relatively greater cross-section, so that the panel hook 220 is not easily detached from the panel hook hole 130 once the panel hook 220 is inserted into the panel hook hole 130.

A plurality of panel coupling projections 222 are formed on a rear side of the front panel 200. The panel coupling projections 222 serve as a fixing means together with the panel coupling parts 132. The panel coupling projections 222 are formed on an upper side and a lower end of the front panel 200.

The panel coupling projections 222 are formed on positions corresponding to positions where the panel coupling parts 132 are formed. In detail, three panel coupling projections 222 are formed with a predetermined interval on each of upper and lower portions of the air outlet 210. Also, three panel coupling projections 222 are formed with a predetermined interval at a lower end of the front panel 200.

The panel coupling projections 222 are potions through and to which a coupling projection such as a screw passes and is coupled. Therefore, a screw groove to which a coupling projection such as a screw is screw-coupled is formed in the panel coupling projection 222.

An additional coupling projection 224 is further formed on a rear side of the front panel 200. The additional coupling projection 224 serves as an additional coupling means together with the additional coupling parts 134, and has the same shape as that of the panel coupling projection 222. Therefore, a coupling member that passes through the additional coupling part 134 is screw-coupled to the additional coupling projection 224.

A corresponding number of additional coupling projections 224 is formed on positions corresponding to positions of the additional coupling parts 134. That is, two additional coupling projections 224 are formed on each of left and right lateral ends on a central portion of the front panel 200.

A discharge fence 230 is formed along an edge of the air outlet 210. The discharge fence 230 protrudes to a rear side along the edge of the air outlet 210. The discharge fence 230 is a portion inserted into the louver installation opening 102 when the front panel 200 is coupled on the front frame 100.

An interference preventing groove 232 is formed to be open to a rear side in a lateral side of the discharge fence 230. The interference preventing groove 232 receives the louver rotational shaft 111 when the discharge fence 230 is inserted into the louver installation opening 102.

Figure 16:
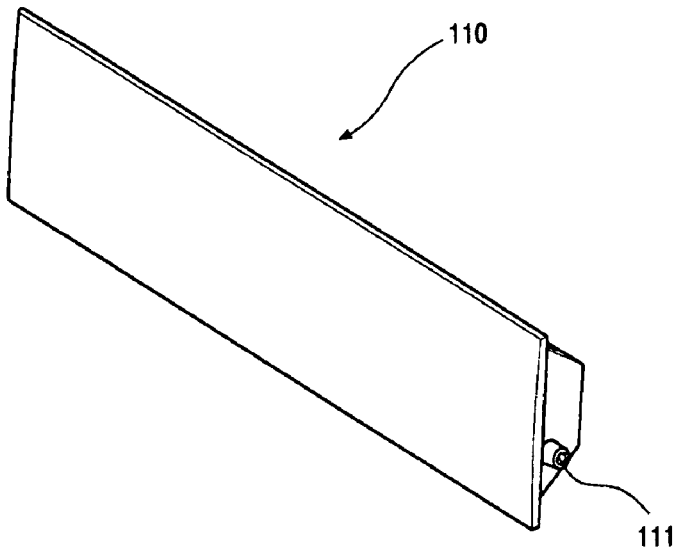
FIGS. 16 and 17 are front and rear perspective views of a discharge louver according to an embodiment of the present invention.
Figure 17:
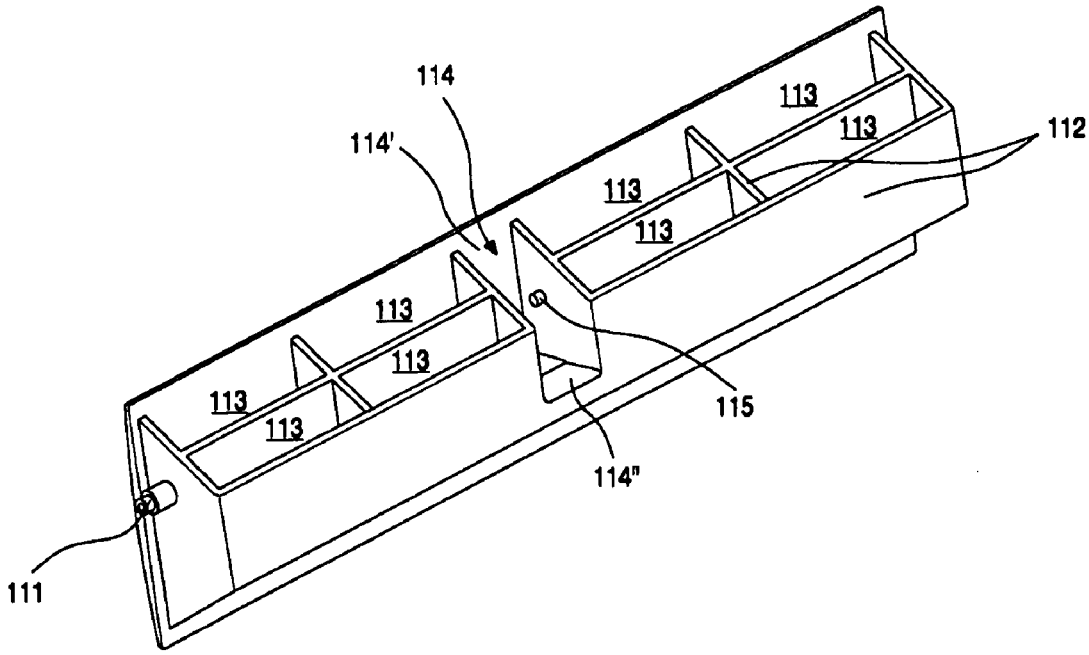

FIGS. 16 and 17 are a front perspective view and a rear perspective view of the discharge louver 110, respectively.

Referring to FIGS. 16 and 17, the louver rotational shafts 111 protrude in a lateral side from both sides of the discharge louver 110. The louver rotational shaft 111 serves as a center of rotation of the discharge louver 110, and is inserted into the louver installation groove 108 of the louver installation part 106.

A plurality of discharge ribs 112 are formed in a grating shape on the discharge louver 110 to constitute a plurality of discharge passages 113. Also, a louver center groove 114 that is open in a rear direction is formed in a central portion of the discharge louver 110. The louver center groove 114 is a portion that receives the louver support 150.

Therefore, as the discharge louver 110 rotates, the louver support 150 touches a groove front side 114' and a groove lower side 114" of the lover center groove 114 to limit a rotation range of the discharge louver 110.

A center support shaft 115 protrudes from a left side (a right side in FIG. 17) of the lover centre groove 114. The center support shaft 115 is located on the same line as the louver rotational shaft 111 and inserted into the louver support hole 156 of the louver support 150.

Figure 18:
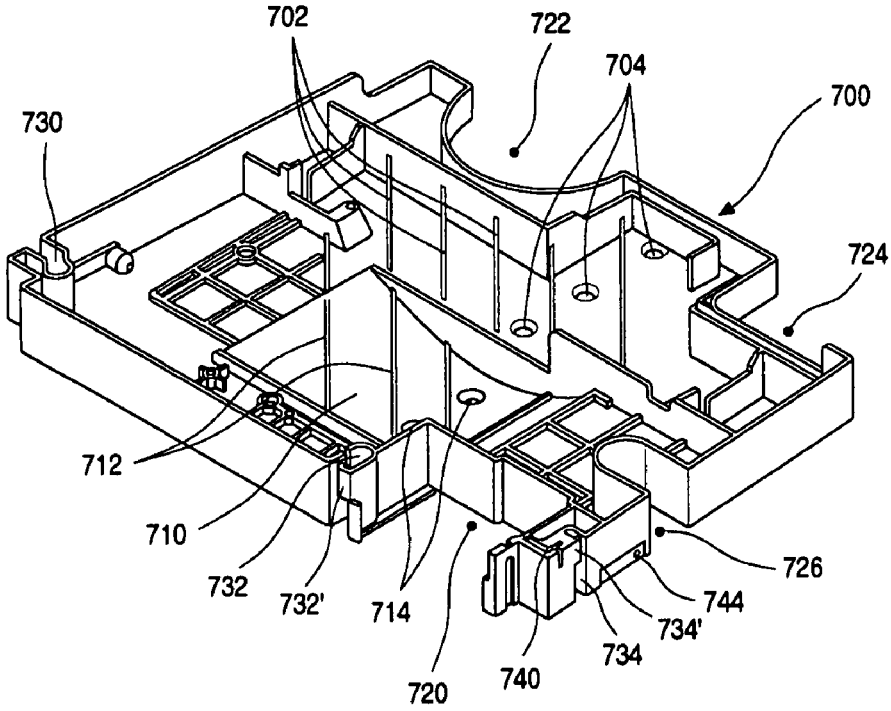
FIGS. 18 and 19 are upper and lower perspective views of a main drain pan according to an embodiment of the present invention.
Figure 19:
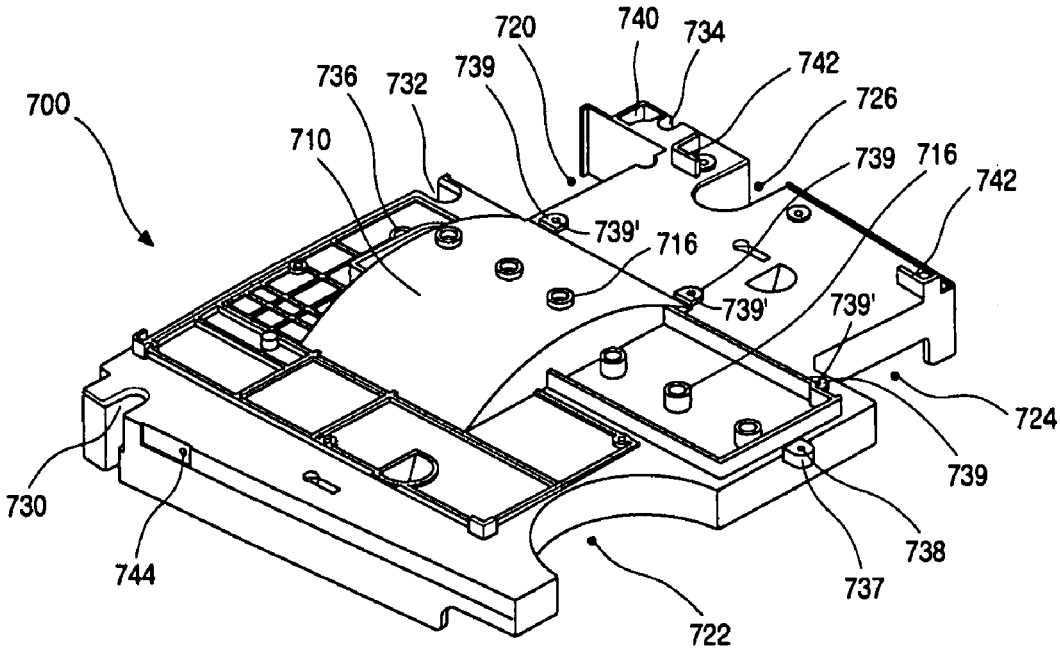

FIGS. 18 and 19 are perspective views illustrating an upper and lower construction of the main drain pan 700, respectively.

Referring to FIGS. 18 and 19, as described above, the main drain pan 700 has an about quadrangle-shaped appearance, and is installed on a central portion between the front frame 100 and the rear frame 300 to divide a space formed by the front and rear frames 100 and 300 into an upper portion and a lower portion.

A plurality of bottom partition ribs 702 are formed on an upper surface of the main drain pan 700 as illustrated. The bottom partition ribs 702 allow a plurality of chambers to be formed on the upper surface of the main drain pan 700 so that spaces through which condensed water can flow.

In more detail, the plurality of bottom partition ribs 702 are formed on the upper surface of the main drain pan 700 with an equal interval. These bottom partition ribs 702 are integrally formed with the main drain pan 700, and protrude upward from the upper surface of the main drain pan 700.

The plurality of bottom partition ribs 702 allow a plurality of parts such as the second heat exchanger 860 installed above the main drain pan 700 not to closely contact the upper surface of the main drain pan 700, so that a predetermined space is formed. Accordingly, condensed water that has been generated from the second heat exchanger 860 and fallen down can easily flow on the upper surface of the main drain pan 700.

Meanwhile, the bottom partition ribs 702 are inclined at predetermined angles with respect to a front side and a lateral side of the main drain pan 700. That is, the bottom partition ribs 702 have a shape inclined to the left to guide flowing of condensed water.

A plurality of bottom condensed water holes 704 are formed in the main drain pan 700 to vertically pass through the main drain pan 700. The bottom condensed water holes 704 allow condensed water that has been generated from the second heat exchanger 860 and fallen down to move below the main drain pan 700.

A housing seat groove 710 recessed downward is further formed on a front half of the main drain pan 700. The housing seat groove 710 is intended for preventing interference with an upper fan housing 810 formed on the upper air guide 800. Therefore, the housing seat groove 710 is formed in an arc shape corresponding to a shape of a lower end of the upper fan housing 810, so that the lower end of the upper fan housing 810 is received in an upper side of the housing seat groove 710.

A plurality of groove partition ribs 712 are integrally formed with an equal interval on the housing seat groove 710. The groove partition ribs 712 are formed in a shape corresponding to a shape of the bottom partition ribs 702. Therefore, the groove partition ribs 712 are formed to be inclined to the left at a predetermined angel, and protrude upward from an upper surface of the housing seat groove 710. Also, groove condensed water holes 714 are formed in the housing seat groove 710 to vertically pass through the housing seat groove 710. The groove condensed water holes 714 have the same shape as that of the bottom condensed water hole 704, and perform the same function.

Also, the plurality of groove condensed water holes 714 are formed in a lowermost end of the housing seat groove 710. That is, the groove condensed water holes 714 are formed in a lowest portion of the housing seat groove 710 that is recessed and rounded downward and has a cross-section of an arc shape (when seen from a front side). This is for swiftly draining condensed water formed in the housing seat groove 710 to a lower side.

Condensed water falling guides 716 are further formed on a lower surface of the main drain pan 700. The condensed water falling guides 716 allow condensed water moving a lower side of the main drain pan 700 via the condensed water holes 704 and 714 to swiftly and directly fall down. That is, the condensed water falling guides 716 allow the condensed water that has moved to the lower side of the main drain pan 700 to directly fall down without flowing to other portions.

Therefore, the condensed water falling guides 716 protrude downward from a lower side of the main drain pan 700, and have a cylindrical shape. In more detail, the condensed water falling guides 716 extend downward from the condensed water holes 704 and 714. That is, the condensed water falling guides 716 extend downward from the bottom condensed water hole 704 and the groove condensed water hole 714, and are formed in a cylindrical shape corresponding to shapes of the condensed water holes 704 and 714.

Meanwhile, a plurality of grooves for avoiding interference with neighboring parts are formed in the main drain pan 700.

In more detail, a control box installation opening 720 is formed to be open on a front right end of the main drain pan 700. The control box installation opening 720 is formed in a size and a shape corresponding to a cross-section of the control box 870. Therefore, the control box 870 is installed vertically across the control box installation opening 720.

A duct avoiding groove 722 is formed to be open in a rear direction in a rear left portion of the main drain pan 700. The duct avoiding groove 722 is intended for avoiding interference with a lower end of the exhaust guide element 400. Therefore, the duct avoiding groove 722 has a semicircle shape corresponding to a front end of the exhaust guide element 400.

A working hole 724 is formed in a rear right portion of the main drain pan 700. The working hole 724 is a portion formed by cutting a rear right edge of the main drain pan 700 in a 'ㄴ'shape. The working hole 724 is intended for easy working (e.g., after service) of an operator.

For example, the compressor 520 is installed below a right end of the main drain pan 700. The compressor 520 is covered with a protection cap (not shown). The working hole 724 is formed to allow an operator to easily mount the protection cap from an upper direction. A pipe passing groove 726 through which a coolant pipe (not shown) passes is formed in a right end of the main drain pan 700. That is, coolant flowing between the first heat exchanger 510, the compressor 520, and the second heat exchanger 860 flows via the coolant pipe formed of a pipe. This coolant pipe is vertically installed in the pipe passing groove 726. The pipe passing groove 726 is formed in a '⊂' shape (when seen from an upper direction) as illustrated.

A cord passing groove 730 is formed in a left front end of the main drain pan 700. The cord passing groove 730 is a groove through which a power cord (not shown) through which external power is applied, and a power line supplying power to the upper motor 820 pass. The cord passing groove 730 has a '⊃' shape (when seen from an upper direction).

A power line passing groove 732 is formed in a front end of the main drain pan 700. That is, the power line passing groove 732 is formed in a left side of the control box installation opening 720. The power line passing groove 732 is a portion through which various power lines supplied to the compressor 520 and the condensed water pump 550 pass.

The power line passing groove 732 is formed in a '∩' shape (when seen from an upper direction) as illustrated. A detachment preventing rib 732' for preventing the power line (not shown) inserted into the power line passing groove 732 from being detached to the front side is further formed at a front end.

An auxiliary groove 734 is further formed in the neighborhood of a right front end of the main drain pan 700. Like the power line passing groove 732, the auxiliary groove 734 is also intended for guiding a plurality of power lines. The auxiliary groove 734 is formed in a smaller size than that of the power line passing groove 732 to pass a DC power line therethrough.

The auxiliary groove 734 is formed in a '⊂' shape (when seen from an upper direction) as illustrated, and a DC line detachment preventing rib 734' is formed at a right end to prevent the power line from being detached.

Drain coupling parts 736, 737, and 739 for coupling with the sub-drain pan 750 are formed on the main drain pan 700. The drain coupling parts 736, 737, and 739 consist of a front drain coupling part 736 formed at a front end of the main drain pan 700, a rear drain coupling part 737 formed at a rear end of the main drain pan 700, and a right drain coupling part 739.

The front drain coupling part 736 is formed at a central front end of the main drain pan 700, and the rear drain coupling part 737 protrudes in a rear direction from a central rear end of the main drain pan 700. A drain coupling hole 738 through which a coupling member such as a screw passes is formed in central portions of the front drain coupling part 736 and the rear drain coupling part 737 to pass through the front drain coupling part 736 and the rear drain coupling part 737.

Three right drain coupling parts 739 are formed at a right portion of the main drain pan 700. That is, the right drain coupling parts 739 are formed at a rear end of the main drain pan 700, a right front end and a right rear end of the housing seat hole 710. A right drain coupling hole 739' like the drain coupling hole 738 is formed also in the right drain coupling part 739 to pass through the right drain coupling part 739.

An angle hole 740 is formed in a front right edge of the main drain pan 700. The angle hole 740 is a portion where a support angle 580 passes and is installed. Therefore, the angle hole 740 is formed in a '¬'shape (when seen from an upper direction) corresponding to a cross-section of the support angle 580. The support angle 580 is inserted from above the angle hole 740.

Also, brace support parts 742 are formed at the neighborhood of a lower right end of the main drain pan 700. The brace support parts 742 are a portion to and on which an upper end of the brace 570 is coupled and supported, protrudes downward (upward in FIG. 19) from a lower surface of the main drain pan 700, and is formed in a pair. That is, the brace support parts 742 are installed with a predetermined interval between them, and have a '⌐'shape and a '¬'shape (when seen from an upper direction in FIG. 19) symmetric with each other as illustrated. Meanwhile, frame coupling recesses 744 are respectively formed in the neighborhood of the left and right front ends of the main drain pan 700. The frame coupling recesses 744 respectively form a screw hole for fastening a screw or other fastening member therein, and are portions for fixing the main drain pan 700 to the front frame 100.

The frame coupling recesses 744 are formed in locations facing the drain coupling holes 144' of the drain coupling member 144 formed on the front frame 100. Therefore, when a screw passes through the drain coupling hole 144' of the front frame 100 and couples to the frame coupling groove 744', a front end of the main drain pan 700 is fixed to the front frame 100.

Figure 20:
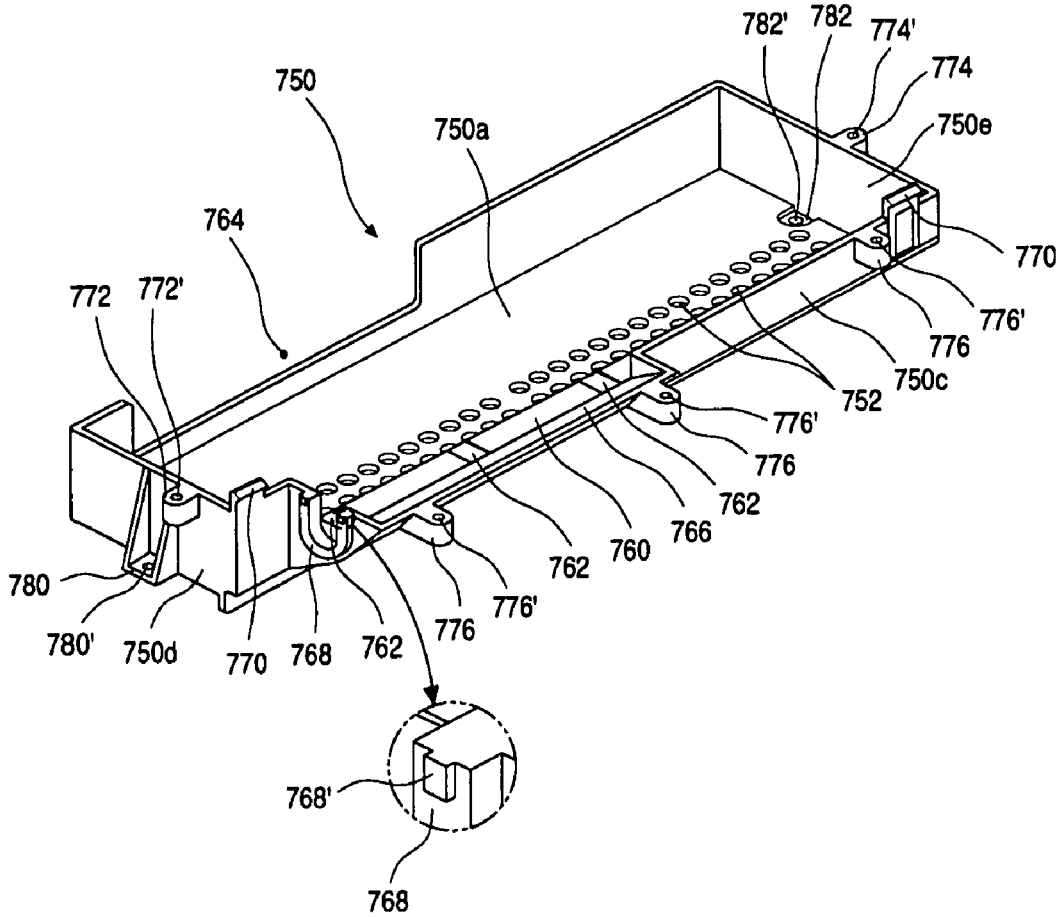
FIGS. 20 and 21 are upper and lower perspective views of a sub-drain pan according to an embodiment of the present invention.
Figure 21:
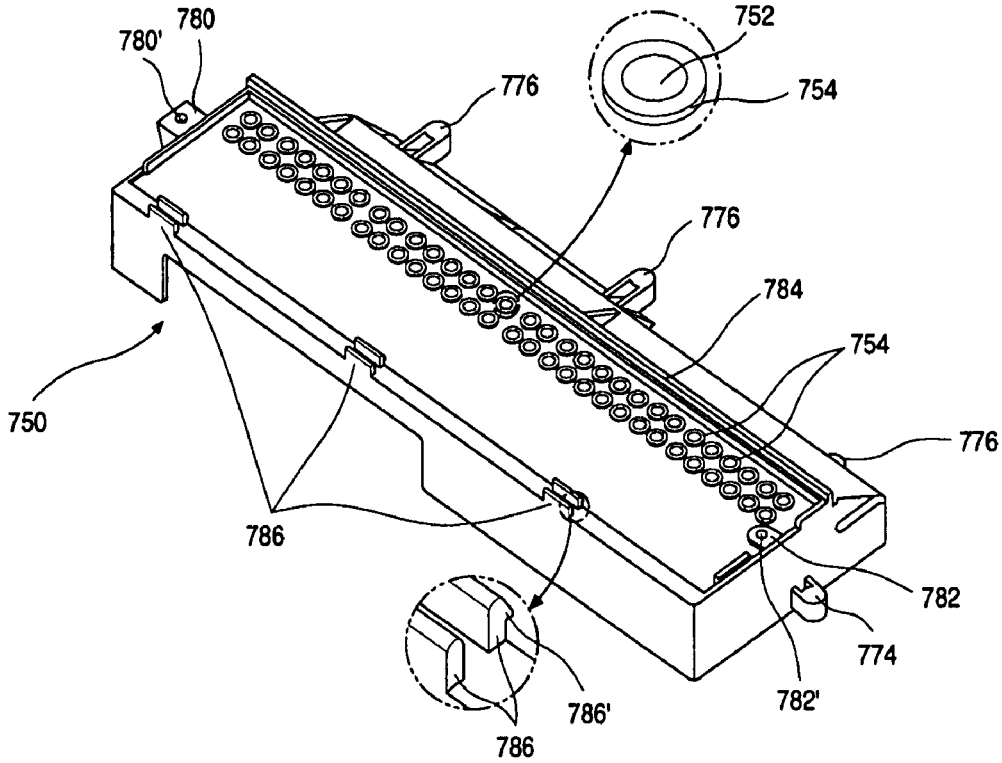

FIGS. 20 and 21 are an upper perspective view and a lower perspective view of the sub-drain pan 750, respectively. A construction of the sub-drain pan 750 will be described below in more detail.

As described above, the sub-drain pan 750 is provided below the main drain pan 700 to collect condensed water generated at the first and second heat exchangers 510 and 860, and allows the collected and condensed water to fall down from the first heat exchanger 510.

Therefore, a plurality of falling holes 752 for allowing condensed water that has been collected to fall down to the first heat exchanger 510 are formed in the sub-drain pan 750. The falling holes 752 are formed in a circular shape and separated side by side with a predetermined interval.

The plurality of falling holes 752 are formed in a plurality of rows. That is, the plurality of falling holes 752 is formed in two rows back and forth in a right portion of a bottom 750*a* of the sub-drain pan 750. Of course, the plurality of falling holes 752 can be formed in one row or three rows or more.

When the sub-drain pan 750 is installed, the plurality of falling holes 752 is located above the first heat exchanger 510. In more detail, the plurality of falling holes 752 is preferably located along a right upper side of the first heat exchanger 510. Therefore, condensed water falling downward via the plurality of falling holes 752 are evaporated while it flows down via a right surface of the first heat exchanger 510.

Falling guide ribs 754 are further formed on a lower surface of the sub-drain pan 750. The falling guide ribs 754 extend downward from a lower end of the falling holes 752 and are formed in a cylindrical shape having a predetermined length to guide falling of condensed water that has passed through the sub-drain pan 750 and moved to a lower side via the falling holes 750.

Meanwhile, the bottom 750*a* of the sub-drain pan 750 is formed to be inclined. That is, the bottom 750*a* has a predetermined slope whose height gradually reduces from a lateral end to the falling holes 752 to allow condensed water collected to an inside of the sub-drain pan 750 to be guided to the falling holes 752.

A right side of the sub-drain pan 750 is formed to have a height difference to constitute a drain guide surface 760. Therefore, the drain guide surface 760 is located at a relatively high position than that of the bottom 750*a* of the sub-drain pan 750. The drain guide surface 760 is a surface where condensed water formed on the base pan 500 flows in and guided.

A plurality of drain guide grooves 762 are recessed downward from the drain guide surface 760. The drain guide grooves 762 are preferably formed with a predetermined interval to allow condensed water supplied to the drain guide surface 760 to easily flow to the bottom 750*a* of the sub-drain pan 750.

A bottom of the drain guide groove 762 is formed to be inclined to the left. That is, the bottom of the drain guide groove 762 has a slope whose height gradually reduces toward a direction in which the falling holes 752 are formed (a left side in FIG. 20). Therefore, flowing of condensed water is swiftly performed by this slope.

A drain avoiding hole 764 is formed in a left side 750*b* of the sub-drain pan 750. The drain avoiding hole 764 is formed by cutting off a portion of the left side 750*b* of the sub-drain pan 750. The drain avoiding hole 764 is intended for preventing interference with the housing seat groove 710 of the main drain pan 700 when the sub-drain pan 750 is coupled to the main drain pan 700.

A drain avoiding surface 766 is formed also on a right side 750*c* of the sub-drain pan 750 facing the drain avoiding hole 764. That is, a front half of the right side 750*c* is formed to be inclined to the right to constitute the drain avoiding surface 766. Like the drain avoiding hole 764, the drain avoiding surface 766 is also intended for avoiding interference with the housing seat groove 710.

A connector coupling part 768 is formed at a right front end of the sub-drain pan 750. The connector coupling part 768 is a portion to which one end of the condensed water pipe 560 is coupled, and has a 'U' shape whose upper direction is open.

Also, a connector fixing projection 768' protrudes to the front from a front upper end of the connector coupling part 768. The connector fixing projection 768' is a portion inserted into a connecting fixing groove 598. The connector fixing projection 768' fixes a pan connector 590 so that the pan connector 590 is not detached from the connector coupling part 768 once the pan connector 590 is coupled to the connector coupling part 768.

Drain hooks 770 are formed at a right front end and a right rear end of the sub-drain pan 750, respectively.

The drain hook 770 includes a general hook formed in a hook shape, and protrudes upward a predetermined distance from a right end of the sub-drain pan 750.

The drain hook 770 allows the sub-drain pan 750 to be primarily and provisionally assembled to the main drain pan 700. That is, when the drain hook 770 is inserted and coupled to a drain hook groove (not shown) formed in the main drain pan 700, the sub-drain pan 750 is primarily coupled to the main drain pan 700. A plurality of drain coupling projections 772, 774, and 776 are formed on the sub-drain pan 750 to allow the sub-drain pan 750 to be coupled to the main drain pan 700. Therefore, the drain coupling projections 772, 774, and 776 are formed at corresponding positions of the drain coupling parts 736, 737, and 739 of the main drain pan 700, respectively.

In more detail, the front drain coupling projection 772 and the rear drain coupling projection 774 protrude to the front and rear from upper ends of a front side 750*d* and a rear side 750*e* of the sub-drain pan 750, respectively. A front drain coupling groove 772' and a rear drain coupling groove 774' to which coupling projections are coupled are formed at a central portions of the front drain coupling projection 772 and the rear drain coupling projection 774, respectively.

Also, three right drain coupling projection 776 are formed on a right end of the sub-drain pan 750. A right drain coupling groove 776' to which a coupling member is coupled is formed in a central portion of each right drain coupling projection 776 to pass through the each right drain coupling projection 776.

Heat exchange coupling members 780 and 782 for coupling with the first heat exchanger 510 are formed back and forth of the sub-drain pan 750. That is, the front heat exchange coupling member 780 protrudes to the front from the front side 750*d* of the sub-drain pan 750, and the rear heat exchange coupling member 782 is formed at a rear end of the bottom 750*a* of the sub-drain pan 750. Also, a front heat exchange coupling hole 780' and a rear heat exchange coupling hole 782' through which coupling members can pass are formed in the front heat exchange coupling member 780 and the rear heat exchange coupling member 782, respectively. Also, a heat exchange support rib 784 is formed long lengthwise at a lower right end (a rear end in FIG. 21) of the sub-drain pan 750. The heat exchange support rib 784 protrudes downward a predetermined distance from a lower surface of the sub-drain pan 750 to contact a right upper end of the first heat exchanger 510. Therefore, the heat exchange support rib 784 supports the first heat exchanger 510 to prevent the first heat exchanger 510 from falling down. A plurality of orifice coupling ribs 786 are formed at a left end (a front end in FIG. 21) of the sub-drain pan 750. The orifice coupling ribs 786 are intended for allowing the sub-drain pan 750 and the lower orifice 600 to be coupled to each other.

The orifice coupling ribs 786 are a pair of ribs separated a predetermined distance, and a hooking threshold 786' is formed on one of the pair of the orifice coupling ribs 786. Therefore, when the orifice coupling rib 786 is inserted into an orifice coupling hole (not shown) formed in an upper surface of the lower orifice 600, the orifice coupling rib 786 is hooked at the hooking threshold 786' and not detached from the orifice coupling hole.

Figure 22:
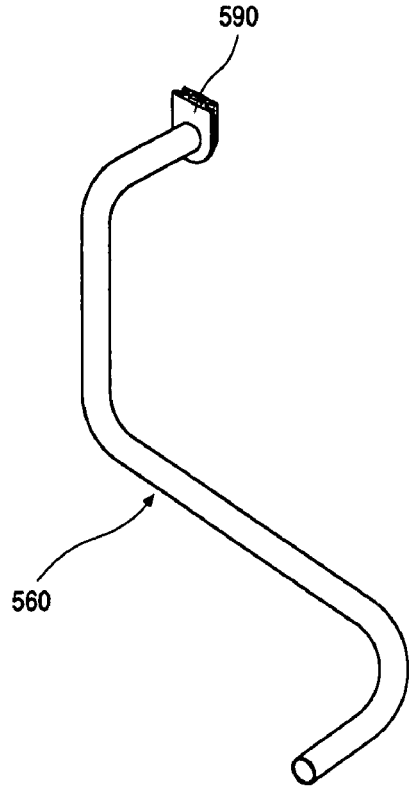
FIG. 22 is a perspective view illustrating a construction of a condensed water pipe according to an embodiment of the present invention.

FIG. 22 illustrates a perspective view of the condensed water pipe 560.

Referring to FIG. 22, the condensed water pipe 560 is formed to have a predetermined length, and installed between the condensed water pump 550 and the sub-drain pan 750 to guide condensed water.

Also, the condensed water pipe 560 is preferably formed of a flexible material so that the condensed water pipe 560 can be freely shaped. That is, the condensed water pipe 560 is formed of a rubber hose which can be transformed.

A lower end of the condensed water pipe 560 is coupled to the condensed water pump 550, and an upper end of the condensed water pipe 560 is detachably mounted on the sub-drain pan 750. That is, the upper end of the condensed water pipe 560 is detachably mounted at a front end of the sub-drain pan 750 using the pipe coupling elements 590 and 768. The pipe coupling elements 590 and 768 include the connector coupling part 768 and the pan connector 590.

Figure 23:
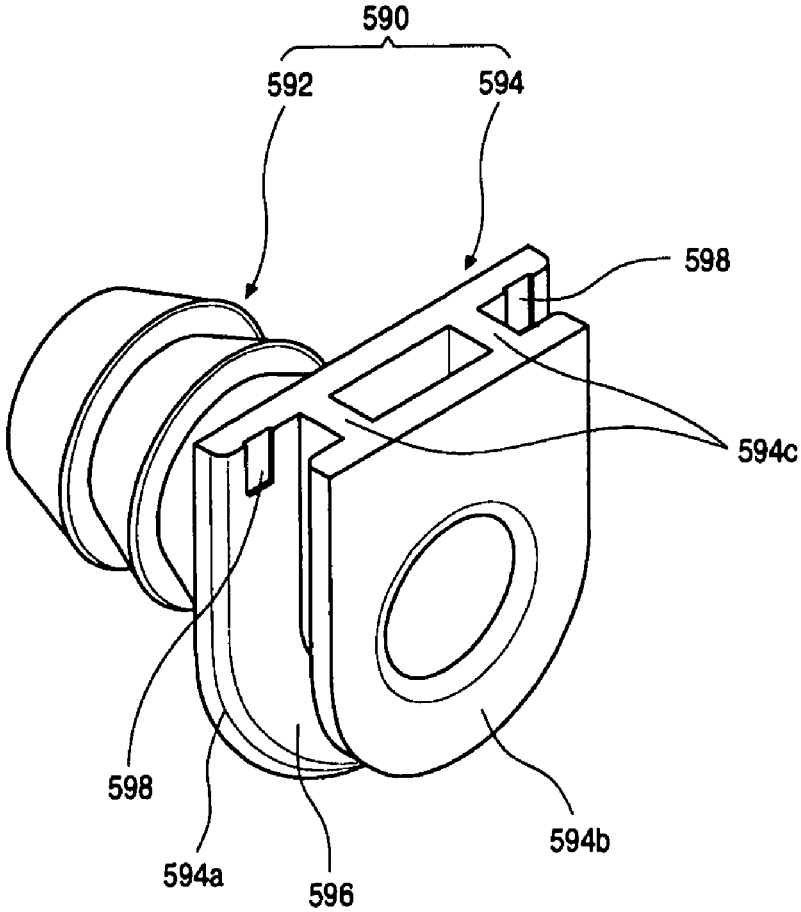
FIG. 23 is a perspective view illustrating a construction of a pan connector according to an embodiment of the present invention.

The pan connector 590 illustrated in FIG. 23 is fit on an upper end of the condensed water pipe 560. The pan connector 590 is mounted on the connecting coupling part 768 of the sub-drain pan 750 in a sliding manner, and serves as one element of the pipe coupling elements 590 and 768. A detailed construction of the pan connector 590 will be described below in detail.

Figure 24:
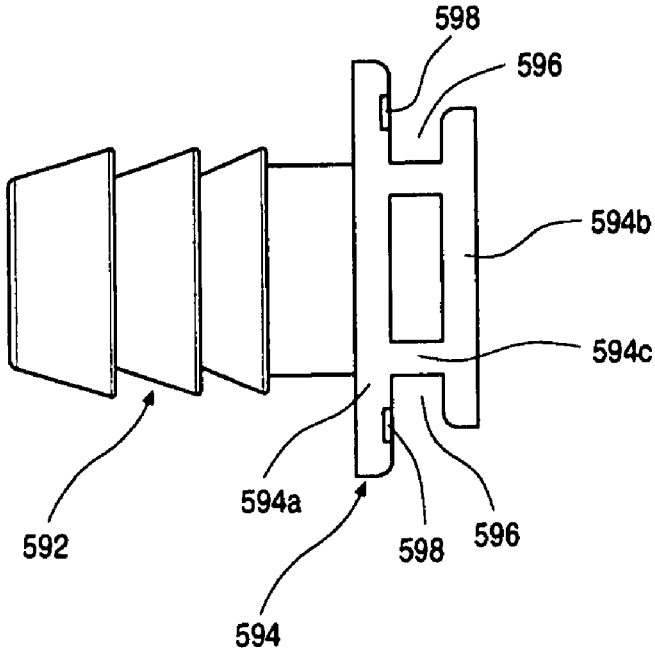
FIG. 24 is a plan view of the pan connector illustrated in FIG. 23.

FIGS. 23 and 24 are a perspective view and a plan view of the pan connector 590.

Referring to FIGS. 23 and 24, the pan connector 590 is formed in a shape corresponding to a shape of the connector coupling part 768 of the sub-drain pan 750, and coupled in a sliding manner.

In more detail, the pan connector 590 includes a pipe connecting member 592 coupled to an upper end of the condensed water pipe 560, and a pan coupling member 594 coupled to the connector coupling part 768.

The pipe connecting member 592 is formed in a shape corresponding to a shape of the circular condensed water pipe 560 and inserted into the condensed water pipe 560. Also, the pipe connecting member 592 is formed to have a cross-section of saw teeth. The reason the pipe connecting member 592 is formed to have a cross-section of saw teeth is for the pipe connecting member 592 not to be easily detached from the inside of the condensed water pipe 560 once inserted.

The pan coupling member 594 includes an outer plate 594*a* contacting one side of the connector coupling part 768, an inner plate 594*b* contacting the other side of the connector coupling part 768, and a connecting rod integrally connecting the outer plate 594*a* with the inner plate 594*b*.

The outer plate 594*a* and the inner plate 594*b* are formed in a semicircular shape, and the outer plate 594*a* is greater than the inner plate 594*b*. Also, the outer plate 594*a* contacts a front side (in FIG. 20) of the connector coupling part 768, and the inner plate 594*b* contacts a rear side (in FIG. 20) of the connector coupling part 768.

Referring to FIG. 23, the inner plate 594*b* is separated a predetermined distance from the outer plate 594*a*. Also, the connecting rod 594*c* is provided between the outer plate 594*a* and the inner plate 594*b* separated the predetermined distance from each other.

Meanwhile, a connector groove 596 having a predetermined width is formed along an outer edge of the connecting rod 594*c*, i.e., between edges of the outer plate 594*a* and the inner plate 594*b*. Therefore, the connecting coupling part 768 is inserted into the connector groove 596.

The connector fixing element 598 and 768' prevent the pan connector 590 from being detached. The connector fixing element 598 and 768' are intended for preventing the fan connector 590 from being detached from the connector coupling part 768 once it is inserted into the connector coupling part 768. The connector fixing element 598 and 768' consist of the connector fixing projection 768' and the connecting fixing groove 598 formed in a shape corresponding to a shape of the connector fixing projection 768'. The connector fixing groove 598 has a quadrangular shape that is the same as a shape of the connector fixing projection 768', and is formed in a rear upper end (a front side in FIG. 23) of the outer plate 594*a*.

Figure 25:
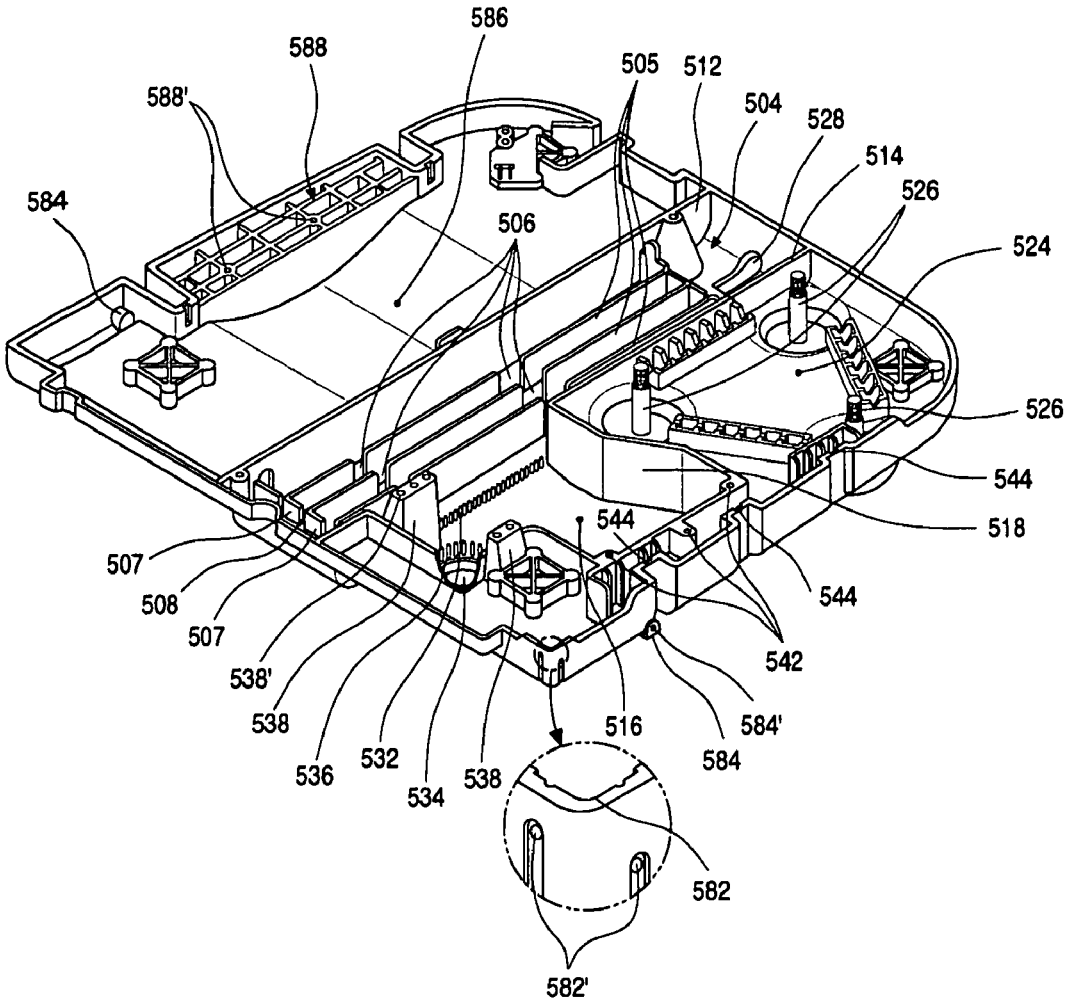
FIG. 25 is an upper perspective view of base pan according to an embodiment of the present invention.

FIG. 25 shows a detailed construction of the base pan 500. Referring to FIG. 25, a heat exchanger installing part 504 is formed crossing a front end and a rear end on an upper surface of the base pan 500. The heat exchanger installing part 504 is a region where the first heat exchanger 510 is installed, and is formed long in the front and rear direction at a center of the base pan 500. The heat exchanger installing part 504 has a plurality of partition support ribs 505 integrally formed with the heat exchanger installing part 504. The plurality of partition support ribs 505 support the first heat exchanger 505 and at the same time form a flowing space of the condensed water collected on the base pan 500. In other words, since the partition support ribs 505 are formed protruded a constant size upward from the upper surface of the base pan 500, a predetermined space is formed between the base pan 500 and the first heat exchanger 510 by the partition support ribs 505 such that the condensed water is well collected and moved.

The plurality of partition support ribs 505 are formed long in the front and rear direction, and have a plurality of base flowing slot 506. In other words, the plurality of partition support ribs 505 are partially cutaway to form the base flowing slots 506. The condensed water can flow in the left or right through these base flowing slots 506. Air shielding ribs 507 for preventing air flowing are further formed at both ends of the partition support rib 505. That is, the air shielding ribs 507 are respectively formed at a front end and a rear end of the plurality of partition support ribs 505. These air shielding ribs 507 are vertically bent to the right from the front end and the rear end of the partition support ribs 505, and extends to the right by a predetermined length. Accordingly, front and rear flowing of air through a space between the plurality of partition support ribs 505 is shield by the air shielding ribs 507. A condensed water flowing clearance 508 is formed between the front end and the rear end of the partition support ribs 505. In other words, a left and right length of the air shielding ribs 507 is formed less than an interval between the plurality of partition support ribs 505. Accordingly, the condensed water flowing clearance 508 is formed between a right end of the air shielding rib 507 and a left end of the partition support rib 505. The condensed water flowing clearance 508 is to enable the flowing of the condensed water in the front and rear direction of the air shielding ribs 507. Separation walls 512 and 514 for preventing the left and right flowing of the condensed water are respectively formed at both sides of the heat exchanger installing part 504. These separation walls 512 and 514 are comprised of the left separation wall 512 forming a left boundary of the heat exchanger installing part 504 and the right separation wall 514 forming a right boundary. The left separation wall 512 and the right separation wall 514 are formed higher than the partition support ribs 505. Accordingly, the condensed water which has fallen down on the upper surface of the base pan 500 along the first heat exchanger 510 is prevented from being diffused into the left and right by the separation walls 512 and 514.

The heat exchanger installing part 504 has a bottom surface formed with a slope toward the right. Accordingly, the condensed water collected in the heat exchanger installing part 504 moves to the right and flows into a water collecting space 516 which will be described later.

The water collecting space 516 having a predetermined size is formed at a right portion of the heat exchanger installing part 504. The water collecting space 516 is a region where the condensed water falling down on the upper surface of the base pan 500 is collected. In more detail, a water collecting wall 518 approximately shaped in a '⊃' (as viewed from an upper side) is formed protruded upward at a right front end of the base pan 500. Accordingly, the water collecting space 516 having the predetermined size is formed inside the water collecting wall 518. The water collecting wall 518 is formed integrally with the right separation wall 514. In other words, a front half of the right separation wall 514 is cut away, and a cutaway portion of the right separation wall 514 contacts the left end of the water collecting wall 518. Accordingly, the heat exchanger installing part 504 communicates with the water collecting space 516.

A first foreign particle shielding rib 532 filtering a foreign particle contained in the condensed water introduced into the water collecting space 516 is formed at a left portion of the water collecting space 516. In other words, the first foreign particle shielding rib 532 is formed in a front and rear direction at the left portion corresponding to an inlet of the water collecting space 516. The first foreign particle shielding rib 532 is formed on an extended line of the right separation wall 514. The first foreign particle shielding rib 532 includes a plurality of protrusions formed at regular distances in a column. In other words, the first foreign particle shielding rib 532 has the plurality of protrusion shaped in a slender cylinder and arranged in the front and rear direction at regular distances. Accordingly, foreign particles having a larger size than the distances between these protrusions do not pass through the first foreign particle shielding rib 532 but are filtered.

The first foreign particle shielding rib 421 can be installed in various configurations. For example, it will be possible that the plurality of protrusions are formed in two or more columns at regular distances or it will be possible that the protrusions are arranged in two or more columns and the protrusions in a first column are arranged positioned between the protrusions in a second column. By the above configuration, the foreign particles can be more effectively filtered.

A water collecting recess 534 is formed at the base pan 500. The water collecting recess 534 is further recessed downward from the upper surface of the base pan 500 to collect the condensed water, and is formed below a region where the condensed water pump 550 is installed. In more concrete, the water collecting recess 534 is formed at a front end of the water collecting space 516, and has a bottom surface deeper than a bottom surface of the water collecting space 516.

A second foreign particle shielding rib 536 is formed along an edge of the water collecting recess 534. More concretely, the second foreign particle shielding rib 536 is formed at a rear side of the water collecting recess 534 in a circular arc shape. This is because a rear side of the water collecting recess 534 is opened such that the condensed water can be introduced.

Like the first foreign particle shielding rib 536, the second foreign particle shielding rib 536 can be installed in various configurations. For example, it will be possible that the plurality of protrusions are formed in two or more columns at regular distances or it will be possible that the protrusions are arranged in two or more columns and the protrusions in a first column are arranged positioned between the protrusions in a second column. By the above configuration, the foreign particles can be more effectively filtered.

The second foreign particle shielding rib 536 functions to filter a foreign particle contained in the condensed water introduced into the water collecting recess 534, and is comprised of the plurality of protrusions formed at regular distances in a column. Accordingly, the condensed water collected from the heat exchanger installing part 504 to the water collecting recess 534 is first filtered by the first foreign particle shielding rib 532 and then again secondly filtered by the second foreign particle shielding rib 536.

A pair of pump supporting bars 538 are formed protruded upward at left and right of the water collecting recess 534. The pump supporting bars 538 are formed symmetric to each other to support the left and right ends of the condensed water pump 550. Accordingly, a plurality of pump coupling holes 538' into which screws are coupled are formed at an upper surface of the pump supporting bars 538. The condensed water detector 540 is installed in the water collecting space 516. Accordingly, a detector coupling hole 542 to which the condensed water detector 540 is fixed by a screw is formed at a right upper end of the water collecting wall 518.

A plurality of brace coupling holes 544 are formed at a right upper end of the base pan 500. The brace coupling holes 544 are screwing holes into which screws are coupled. Accordingly, a lower end of the brace 570 is fixed to a right end of the base pan 500 by the brace coupling holes 544 and the screws.

An angle-lower end installing part 582 on which a lower end of the support angle 580 is installed is formed. The lower end of the support angle 580 is installed so as to contact an inner surface of a right corner of the base pan 500, and an angle coupling hole 582' for fixing the lower end of the support angle 580 using a screw penetrates through and formed at the angle-lower end installing part 582.

Accordingly, as a screw penetrates the angle coupling hole 582' from the outside and then coupled to the lower end of the support angle 580, the lower end of the support angle 580 is fixed to the base pan 500.

The front end of the base pan 500 is coupled to a lower end of the front frame 100. Accordingly, frame fixing members 584 coupled to the base coupling member 146 formed at a lower end of a side of the front frame 100 are respectively formed at both sides of the base pan 500. The frame fixing members 584 are respectively formed at positions spaced apart a predetermined distance backward from left and right corners of the front end of the base pan 500, and frame fixing holes 584' into which screws are coupled are respectively formed at the frame fixing members 584.

Accordingly, as screws penetrate the base coupling holes 146' of the base coupling members 146 and are coupled to the frame fixing holes 584', the base pan 500 and the front frame 100 are coupled to each other.

A housing base recess 586 for avoiding an interference with the housing base groove 640 is formed recessed downward from the upper surface of the base pan 500. The housing base groove 586 is provided to avoid an interference with a lower portion of the housing grooves 640 respectively formed at the lower orifice 600 and the lower air guide 620, and is formed at a left center of the left separation wall 512.

A motor support part 588 is formed at a middle of a left side of the base pan 500. The motor support part 588 is a region where a bottom of the lower motor support 670 is installed. Accordingly, the motor support part 588 has a plurality of support coupling bores 588' for fixing the bottom of the lower motor support 670 using screws.

A compressor installing part 524 is formed at a rear right region of the base pan 500. The compressor installing part 524 is a region where the compressor 520 is installed. Accordingly, the compressor installing part 24 has three compressor fixing bolts 526 integrally formed therewith. Accordingly, the compression frame 5222 is fixed to the compressor fixing bolts 526.

A condensed water drain hole 528 for draining the condensed water collected on the base pan 500 to the outside is formed in the base pan 500. The condensed water drain hole 528 is formed at a rear side of the heat exchanger installing part 504, and is formed to penetrate a rear surface of the base pan 500. Accordingly, the condensed water collected on the heat exchanger installing part 504 is drained to the rear side of the base pan 500 by drain control means 900. In other words, the condensed water collected on the upper surface of the base pan 500 is drained to the rear side through the condensed water drain hole 528 by a user's selection, and the drain control means 900 is provided to drain the condensed water.

Hereinafter, the construction of the drain control means 900 will be described with reference to FIG. 26.

Figure 26:
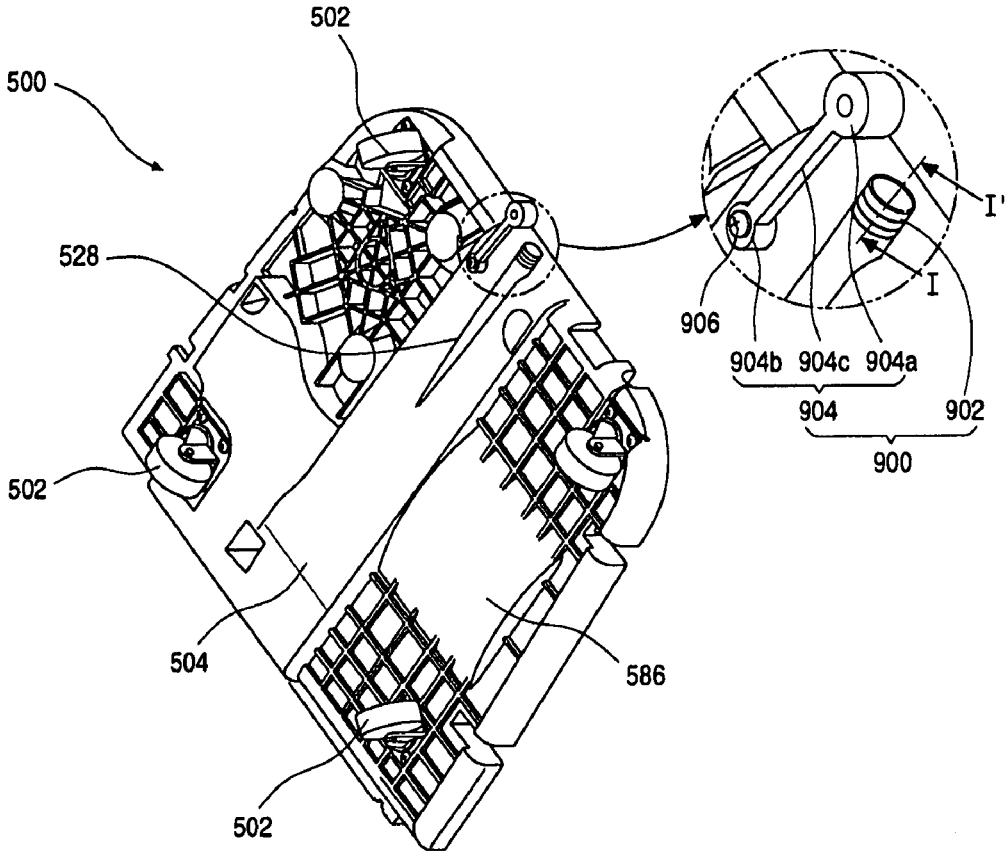
FIG. 26 is a lower perspective view of base pan according to an embodiment of the present invention.

Referring to FIG. 26, the drain control means 900 is provided on a rear surface of the base pan 500. The drain control means 900 controls the drain of the condensed water collected on the base pan 500 to the outside by a user's selection, and is comprised of a condensed water drain pipe 902 and a drain pipe cover 904.

As shown in FIG. 26, the condensed water drain pipe 902 is formed by further protruding and extending the condensed water drain hole backward. In other words, the condensed water drain pipe 902 is formed protruding backward from a rear lower end of the base pan 500 to guide the condensed water toward a rear side of the base pan 500. The condensed water drain pipe 902 is shaped in a slender cylinder as shown in the drawings.

The drain pipe cover 904 selectively shields the condensed water drain pipe 902, and is fixedly installed on a bottom surface of the base pan 500. The drain pipe cover 904 is made of a flexible material capable of bending. The drain pipe cover 904 includes a cover cap **904*a* for shielding a rear end of the condensed water drain pipe 902, a cover coupling part 904*b* coupled to the base pan 500, and a cover connecting part 904*c* connecting the cover cap 904*a* and the cover coupling part 904*b***.

The cover cap **904*a* encloses an outer surface of the condensed water drain pipe 902. Accordingly, the cover cap 904*a* is shaped in a cylinder of which one end (lower end in FIG. 26) is opened, and is provided therein with a groove having a corresponding shape to the outer surface of the condensed water drain pipe 902. It is preferable that the condensed water drain pipe 902 be forcibly fitted and coupled to the cover cap 904*a***.

The cover coupling part **904*b* is fixed to the rear surface of the base pan 500 by a coupling screw 906. The cover connecting part 904*c* is formed at a predetermined length, and is made of a material easily capable of bending while the cover cap 904*a* is inserted onto or released from the condensed water drain pipe 902**.

Figure 27:
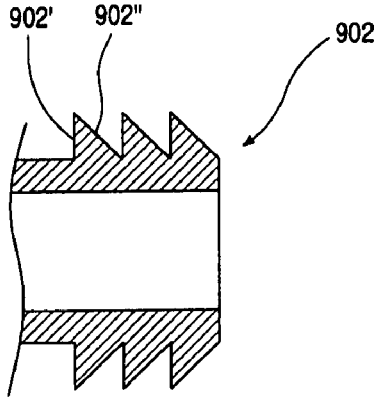
FIG. 27 is a sectional view taken along the line I-I' of FIG. 26.

The condensed water drain pipe 902 is formed with a saw tooth-shaped section. That is, as shown in FIG. 27, the outward appearance of the condensed water drain pipe 902 is formed with the saw tooth-shaped section. These saw teeth are formed in a direction into which the cover cap 904*a* can be easily inserted. That is, as shown in FIG. 27, a left side 902' is a vertical surface, and a right side 902" is a declined surface such that the cover cap 904*a* inserted into the condensed water drain pipe 902 is not easily released.

Figure 28:
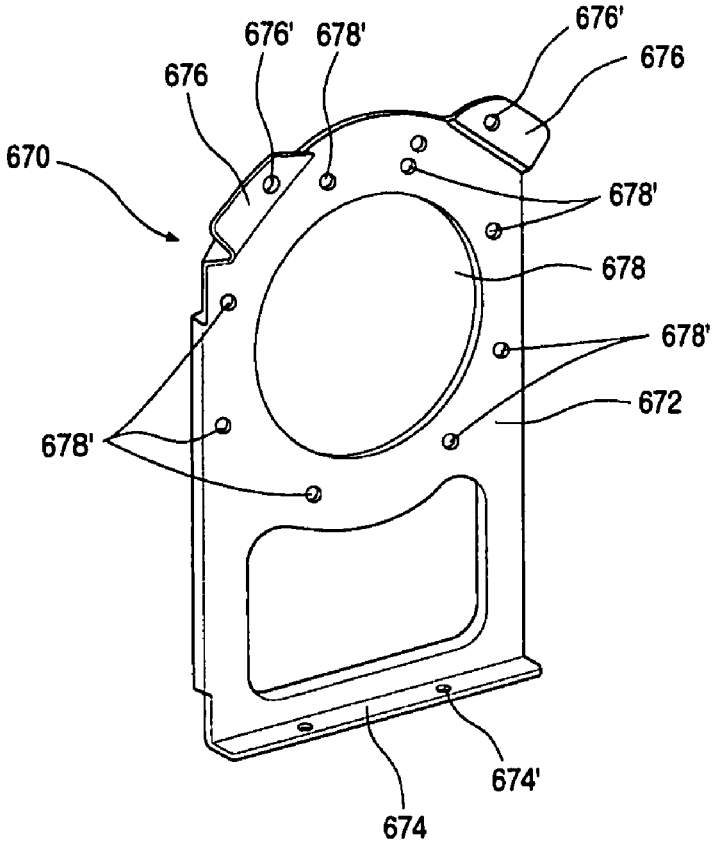
FIG. 28 is a perspective view of a motor support according to an embodiment of the present invention.

FIG. 28 is a perspective view of the lower motor support 670.

Referring to FIG. 28, the lower motor support 670 is installed on the base pan 500, i.e., on the motor support part 588 as described above, and includes a main body plate 672, a base coupling part 674, and an air guide coupling part 676. The main body plate 672 closely contacts the left side of the lower air guide 620, and is formed at a predetermined height in an up and down direction. The base coupling part 674 is formed below the main body plate 672, and closely contacts and is fixed to the motor support part 588 of the base pan 500. In other words, the base coupling part 674 is vertically bent from a lower end of the main body plate 672 and extends to contact the motor support part 588.

Accordingly, base coupling holes 674' are formed penetrating into the base coupling part 674. Accordingly, if screws are inserted into the base coupling holes and coupled to the support coupling bores 588', the base coupling part 674 is fixed on the upper surface of the motor support part 588.

The air guide coupling part 676 is formed at an upper end of the main body plate 672. That is, the air guide coupling part 676 is a part coupled to the lower air guide 620, and is bent forward from the left and right of the upper end of the main body plate 672, protruded, again vertically bent upward and extends. Accordingly, air guide coupling holes 676' through which screws penetrate are formed at the air guide coupling part 676.

A circular motor penetration hole 678 is formed at a center of an upper half section of the main body plate 672. The motor penetration hole 678 is a region where a left end of the lower motor 660 is inserted into and installed. Accordingly, the motor penetration hole 678 has a size corresponding to an outer diameter of the left end of the lower motor 660.

A plurality of motor coupling holes 678' are formed penetrating through a periphery of the motor penetration hole 678. The motor penetration hole 678 is provided for coupling the lower motor 660 to the lower motor support 670 using screws.

Figure 29:
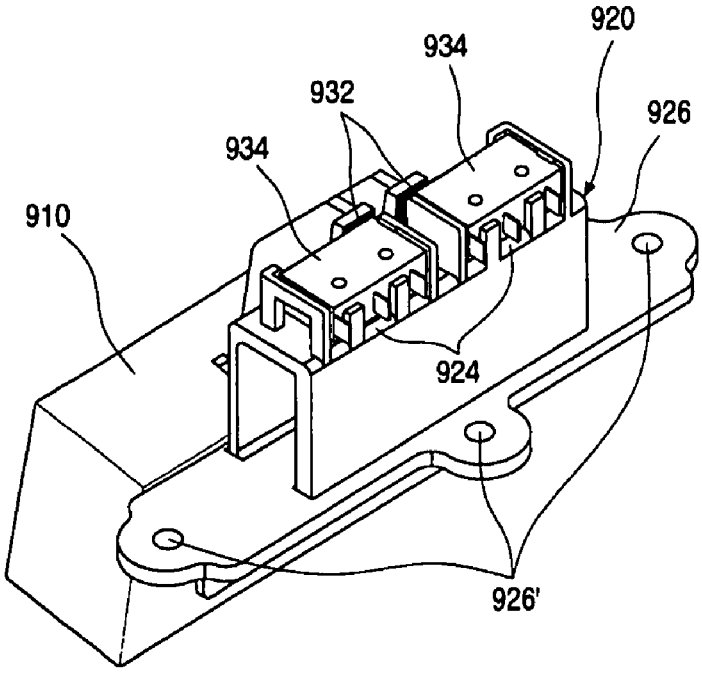
FIG. 29 is a perspective view of a condensed water detector according to an embodiment of the present invention.
Figure 30:
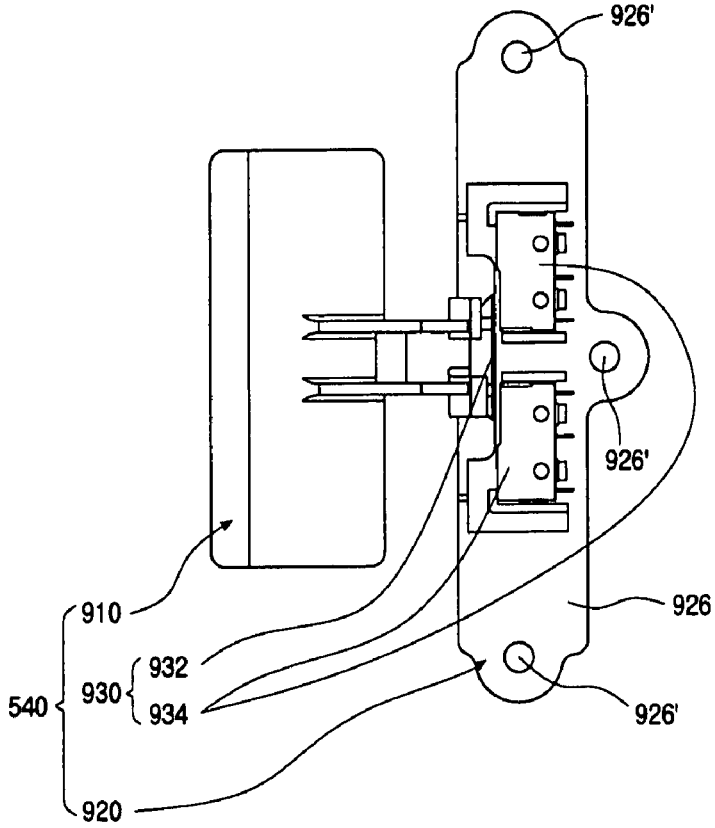
FIG. 30 is a plane view of the condensed water detector shown in FIG. 29.
Figure 31:
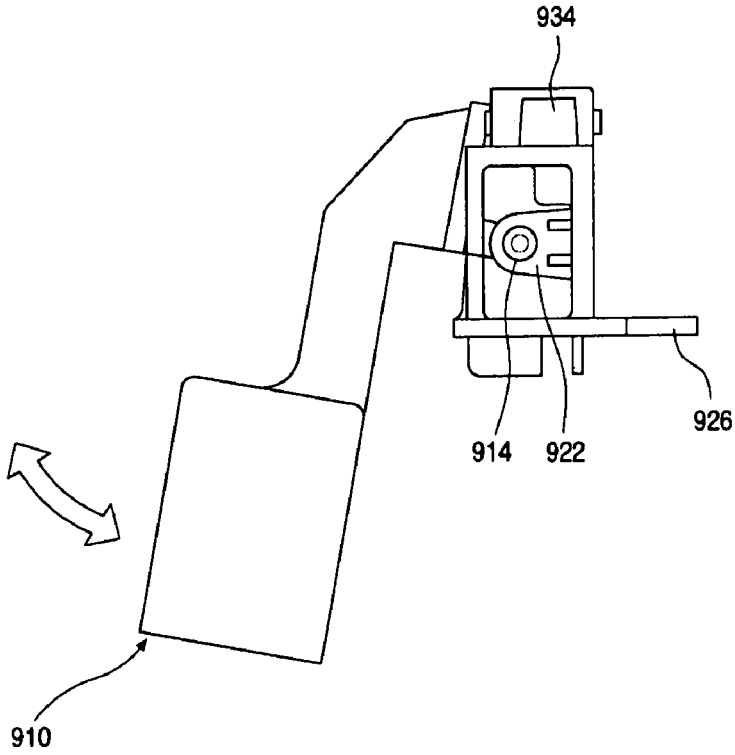
FIG. 31 is a front view of the condensed water detector shown in FIG. 29.
Figure 32:
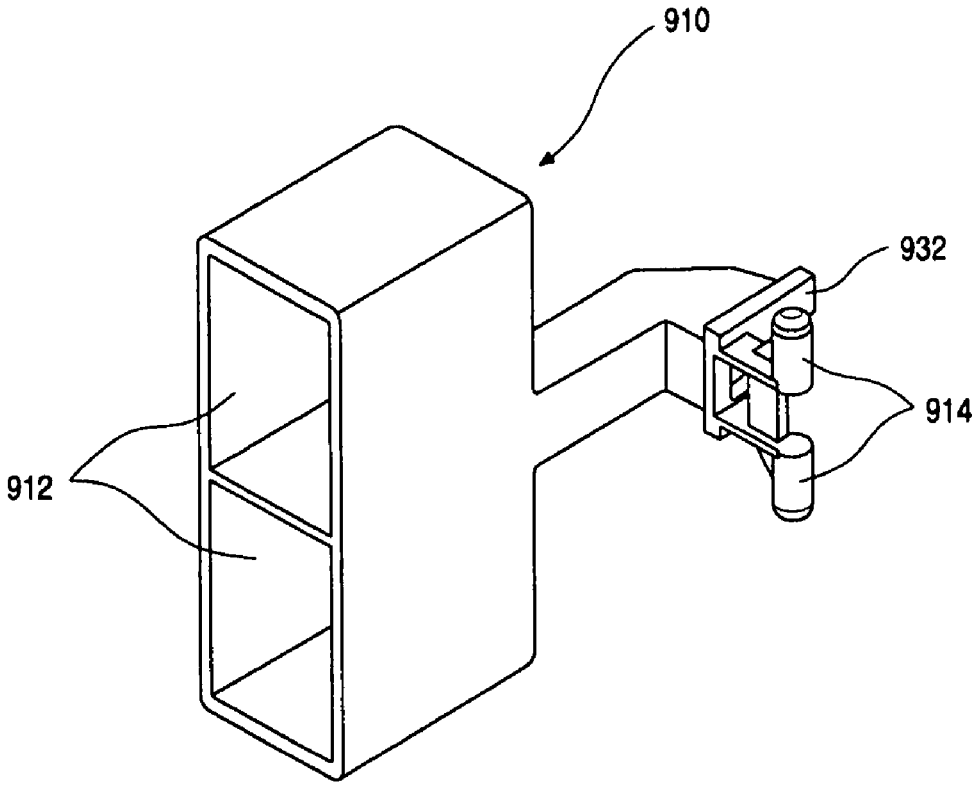
FIG. 32 is a perspective view of a bladder member constituting the condensed water detector shown in FIG. 29.
Figure 33:
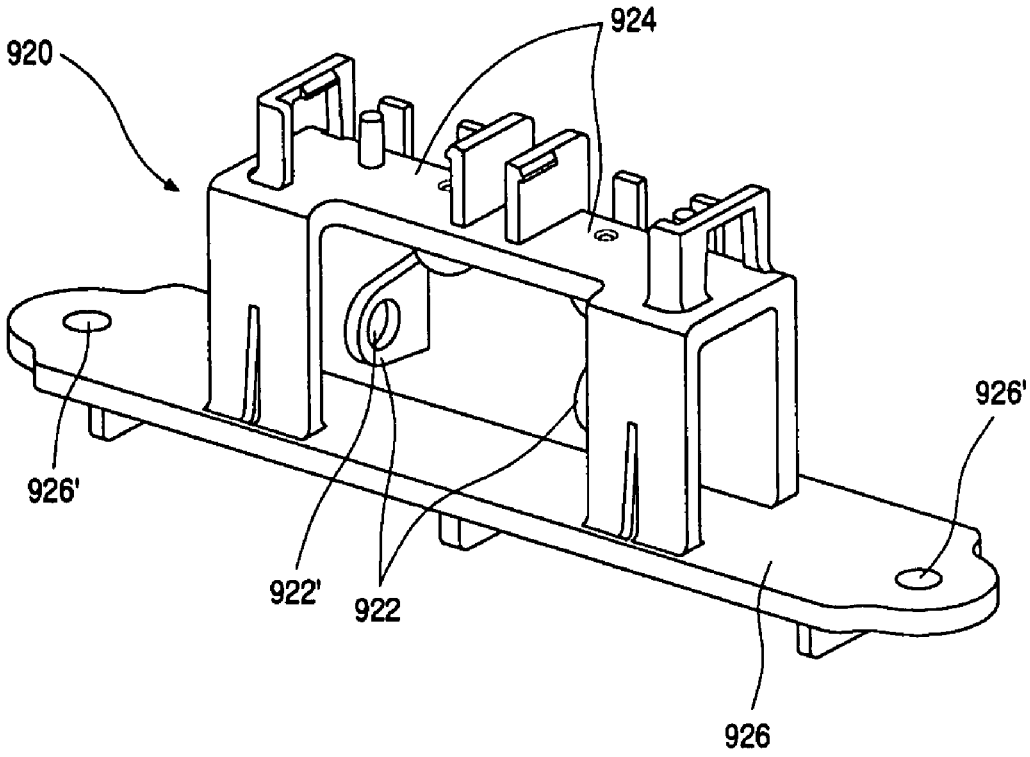
FIG. 33 is a perspective view of a supporting member constituting the condensed water detector shown in FIG. 29.

FIGS. 29 through 33 show a detailed construction of the condensed water detector 540. That is, FIG. 29 is a perspective view of the condensed water detector 540, FIGS. 30 and 31 are plane view and front view of the condensed water detector 540, and FIGS. 32 and 33 are perspective views of a bladder member and a support member constituting the condensed water detector 540.

As shown in these drawings, the condensed water detector 540 includes a bladder member 910 moving up and down depending on the amount of the condensed water, a support member 920 supporting the bladder member 910, and switch means 930 respectively provided in the bladder member 910 and the support member 920 and switched on or off depending on the amount of the condensed water.

The bladder member 910 is rotatably installed in the support member 920, and made of a construction or material having a buoyancy. Accordingly, the bladder member 910 moves up as the amount of the condensed water collected on the base pan 500 increases.

In more concrete, one half of the bladder member 910 is formed in a rectangle shape, and has bladder holes 912 where air stays. The bladder holes 912 have an opened upper end (see FIG. 32).

A hinge shaft 914 and a conducting member 932 are respectively formed above the bladder member 910. In other words, the hinge shaft 914 is protruded in a front and rear direction at a right upper side of the bladder member 910. The hinge shaft 914 becomes a rotational center of the bladder member 910.

The switch means 930 is comprised of the conducting member 932 and a pair of electrode terminals 934. The conducting member 932 selectively connects the pair of electrode terminals 934 to turn on either, and is provided at the right upper side of the bladder member 910.

The conducting member 932 is preferably made of a material with a high conductivity, for example, copper (Cu). This conducting member 932 is formed in a flat plate shape corresponding to the shape of the right upper side of the bladder member 910, and is fixed to the right upper side of the bladder member 910. However, it is also possible to build the conducting member 932 in the bladder member 910. In other words, it will be possible that most of the conducting member 932 is built in an upper inside of the bladder member 910, both ends are exposed at the right side and contact the pair of electrode terminals 934.

The pair of electrode terminals 934 have different polarities. That is, one can have a positive (+) polarity, and the other can have a negative (−) polarity. The pair of electrode terminals 934 are spaced apart a predetermined distance from each other. That is, the pair of electrode terminals 934 are installed at a terminal installing part 924 of the support member 920 which will be described later, spaced apart a predetermined distance from each other. Accordingly, in a normal state, current does not flow between the pair of electrode terminals 934.

The support member 920 is installed at a right side of the water collecting wall 518 of the base pan 500. An upper end of the bladder member 910 is rotatably installed at the support member 920.

In more concrete, a pair of hinge installing members 922 are installed at the support member 920 and are protruded toward the left. A hinge hole 922' is formed at each of the pair of hinge installing members 920. Accordingly, both ends of the hinge shaft 914 of the bladder member 910 are inserted into the hinge holes 922' and coupled thereto.

The terminal installing part 924 where the pair of electrode terminals 934 are respectively installed is formed at an upper side of the support member 920.

An installing plate 926 fixed to the water collecting wall 518 is provided at a lower side of the support member 920. The installing plate 926 is formed with a plurality of detector penetration holes 926' corresponding to the detector coupling holes 542. Accordingly, if screws are inserted into the detector penetration holes 926' and coupled to the detector coupling holes 542, the support member 920 is fixed to the right side of the water collecting wall 518.

An operation of the air conditioner having the above-described construction will be described below.

First, flowing of coolant and air in the air conditioner according to the present invention will be described.

Though the air conditioner can be used for cooling and heating, description will be made for the case where the air conditioner is used for cooling.

The first heat exchanger 510 serves as a condenser, and the second heat exchanger 860 serves as an evaporator. Also, coolant pipes (not shown) are connected between the compressor 520, the first heat exchanger 510, and the second heat exchanger 860 to guide flowing of coolant.

Therefore, when gas coolant from the compressor 520 is compressed to become coolant of high temperature and high pressure, and flows into the first heat exchanger 510, the first heat exchanger 510 exchanges heat with outside air to condense coolant.

After that, condensed coolant expands while it passes through an expansion valve (not shown), and flows into the second heat exchanger 860. The coolant that has flowed to the second heat exchanger 860 exchanges heat with outside air to evaporate. Therefore, the coolant becomes a gas state. At this point, liquid state coolant also remains, so that coolant in two phases is mixed and present actually.

The coolant passes through the accumulator 530 and is sent back to the compressor 520 to complete a circulation cycle of the coolant.

Figure 34:
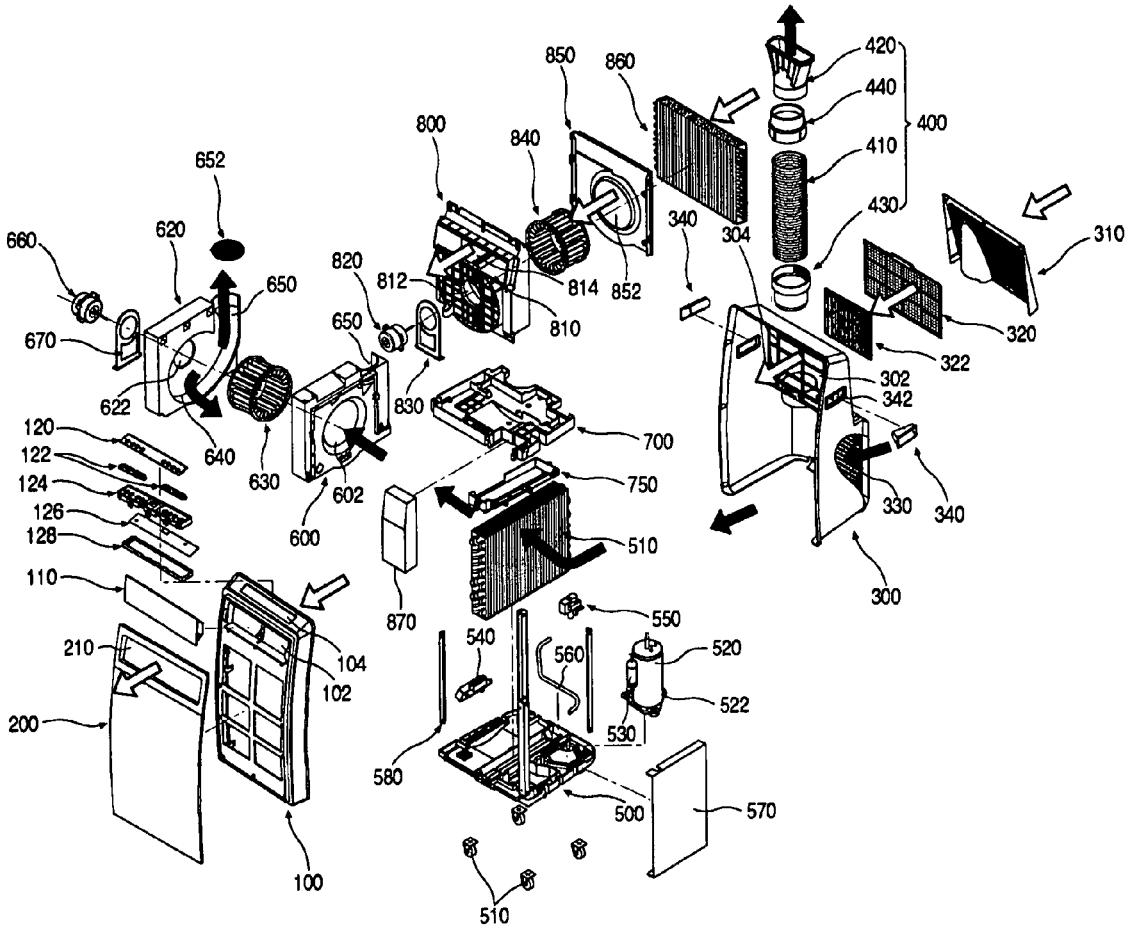
FIG. 34 is an exploded perspective view showing relations between a front frame, a rear frame, a base pan, and a main drain pan when they are installed.

Meanwhile, air exchanges heat while it passes through the first and second heat exchangers 510 and 860. This process is described with reference to FIGS. 1, 2, and 34.

First, air flow (denoted by '⇦'in FIG. 26) at a heat sinking side (a lower side of the main drain pan) is described. The air flow at this point is basically generated by the lower fan 630. That is, when the lower motor 660 is driven by power applied from the outside, the lower fan 630 connected to a shaft of the lower motor 660 rotates to generate air flow.

Therefore, air from a rear side flows in via the lower grill 330 formed in a lower half of the rear frame 300. The air flowing to the front via the lower grill 330 changes its direction to flow to the left side and pass through the first heat exchanger 510.

Temperature of air that passes through the second heat exchanger 860 is raised. That is, since the second heat exchanger 860 serves as a condenser, air receives heat from coolant flowing through the second heat exchanger 860 to become high temperature air The high temperature air that has passed through the second heat exchanger 860 passes through the lower orifice hole 602 to flow into a central portion of the lower fan 630. The air that has flowed into the central portion of the lower fan 630 flows radially as the fan 630 rotates, and is guided by the exhaust guides 650 and discharged upward.

High temperature air guided upward by the exhaust guides 650 is completely exhausted to an outside of a building via the exhaust guide element 400.

Next, air flow (denoted by '⬅'in FIG. 26) generated at a heat absorption side (an upper side of the main drain pan) is described. Air flow at this point is basically generated by the upper fan 840. That is, when the upper motor 820 is driven by power applied from the outside, the upper fan 840 connected to a shaft of the upper motor 820 rotates to generate air flow.

Therefore, air of an indoor space flows into the inside (the front side) via the suction grill 310 formed in an upper half of the rear frame 300. The air that flows in via the suction grill 310 sequentially passes through the pre-filter 320 and the deodorization filter 322, so that foreign substances or bad smell contained in the air is removed.

The air that has passed through the pre-filter 320 and the deodorization filter 322 exchanges heat with the second heat exchanger 860 while it passes through the second heat exchanger 860. That is, since the second heat exchanger 860 serves as an evaporator, air that passes through the second heat exchanger 860 is cooled down by exchanging heat with coolant flowing through the second heat exchanger 860.

Low temperature air that has passed through the second heat exchanger 860 flows to the front via the upper orifice hole 852 and flows into a central portion of the upper fan 840. The air that has flowed into the central portion of the upper fan 840 is discharged radially as the upper fan 840 rotates. The air is guided by the upper fan housing 810 to flow upward.

The air that flows upward by the upper fan housing 810 moves to the front via the discharge guide opening 814 of the upper air guide 800 to pass through the discharge louver 110. The low temperature air that passes through the discharge louver 110 is discharged through the front of the air outlet 210 and cools the interior space. The air that is discharged through the discharge louver 110 can be made to change direction by means of the plurality of ribs formed on the discharge louver 110.

Next, a process of fixing the suction grill 310 to the rear frame 300 will briefly be described.

First, the suction grill 310 is placed in proximity at the rear of the rear frame 300. Then, the grill coupling projections 317 formed on the bottom of the suction grill 310 are inserted into the grill projection receiving holes 354.

After the grill coupling projections 317 are inserted in the grill projection receiving holes 354, the upper end of the suction grill 310 is pushed forward. Then, the grill coupling hooks 316 formed at the top of the suction grill 310 are inserted into the grill hook coupling holes 374. When the grill coupling hooks 316 are inserted in the grill hook coupling holes 374, disengaging of the suction grill 310 is prevented by the hooking parts 316' formed on the upper portions of the grill coupling hooks 316. Through this process, the suction grill 310 is mounted to the rear frame 300.

In order to separate the suction 310 grill that was attached through the above process, the procedures are performed in reverse order.

That is, in order to separate the suction grill 310, the detachment rib 315 is grasped by hand and pulled forward. Accordingly, the grill coupling hooks 316 move laterally by means of their own elasticity, and the hooking parts 316' of the grill coupling hooks 316 pass through the grill hook coupling holes 374 and move rearward.

Then, the suction grill 310 is lifted, whereupon the grill coupling projections 317 of the suction grill 310 detach from the grill projection receiving holes 354 and disengage in an upward direction. The suction grill 310 is separated through the above procedure.

If a user wishes to lift the air conditioner, the user's hands grasp the pair of knobs 340 to lift the unit. Here, it is preferable for a user to stand in front of the air conditioner to lift it. That is, because the inner space of the knobs 340 gradually increase towards the rear, it is preferable for human index fingers to be positioned at the rear of the knobs 340.

In order to assemble the knobs 340 to the knob holes, the knobs 340 may be pressed inward from either side. That is, the fixing ribs 348 of the knobs 340 form guide surfaces 348" that are formed to slope toward one side (the inner side) surface, so that when the knobs 340 are pushed into the knob holes 342, the guide surfaces 348" contact the perimeters of the knob holes 342, allowing them to slide. Accordingly, when force is continuously exerted in a lateral direction, the fixing rib 348 moves to the inside of the knob hole 342, and the side surface of the rear frame 300 is positioned at the knob groove 349 of the knob 340. The attaching of the knob 340 is thereby completed.

Also, in order to attach the front panel 200 to the front frame 100, first, after the front panel 200 is coupled to the front frame 100 by means of the above-described provisional assembling element, the assembling element described above is used to complete the coupling.

In further detail, the front panel 200 is first pressed against the front of the front frame 100, and the plurality of panel hooks 220 are inserted into the plurality of panel hook holes 130 to provisionally assemble the front panel 200.

Thereafter, after screws or other fastening members pass through the panel coupling holes 132' of the panel coupling parts 132 from the rear of the rear frame 300, the fastening members are screwed and fastened to the panel coupling projections 222, in order to complete the fixing of the front panel 200 to the front frame 100.

In the case where the front panel 200 is heavy, an auxiliary fixing element as described above is used to more firmly fix the front panel 200 to the front frame 100. Here, the process is the same as that used with the fixing element.

Next, referring to FIG. 18, the flow of condensed water from the top of the main drain pan 700 will be described. Heat is exchanged by the second heat exchanger 860 between the outside air and the coolant inside, and moisture is drawn from the air during this process to generate condensed water. The condensed water generated in this process flows to the bottom of the second heat exchanger 860 to fall onto the top of the main drain pan 700. The condensed water falling on the top surface of the main drain pan 700 is guided by and flows along the bottom partition ribs 702, and passes through the bottom condensed water holes 704 to pass through the main drain pan 700 and move downward.

The condensed water on the top surface of the main drain pan 700 flows to the housing seat groove 710. That is, the housing seat groove 710 is formed at a location that is lower than that of the main drain pan 700, so that a portion of the condensed water flows to the housing seat groove 710.

The condensed water that moves to the housing seat groove 710 is guided by the groove partition ribs 712, and moves gradually to the bottom of the housing seat groove 710. Then, the water flows further downward through the groove condensed water holes 714 formed in the left, lower end of the housing seat groove 710. The condensed water that passes through the condensed water holes 704 and 714, that is, the bottom condensed water holes 704 and the groove condensed water holes 714, and moves to the bottom of the main drain pan 700, flows along the inner surfaces of the condensed water falling guides 716, and then collects at the bottom of the condensed water falling guides 716 and falls downward. The condensed water that falls from the condensed water falling guides 716 falls on the top surface of the sub-drain pan 750.

Figure 35:
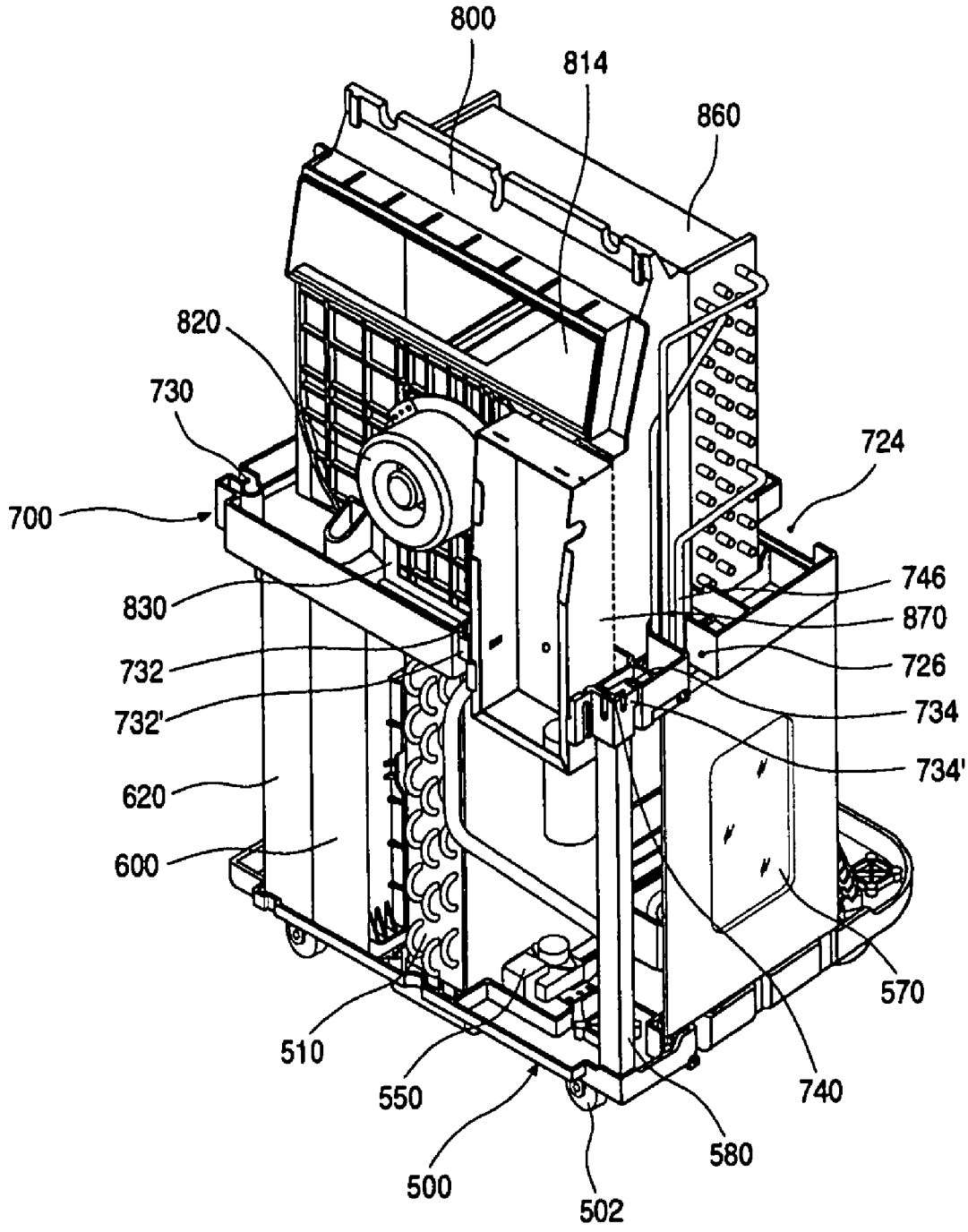
FIGS. 35 and 36 are front and rear perspective views of an inner construction of the air conditioner according to an embodiment of the present invention.
Figure 36:
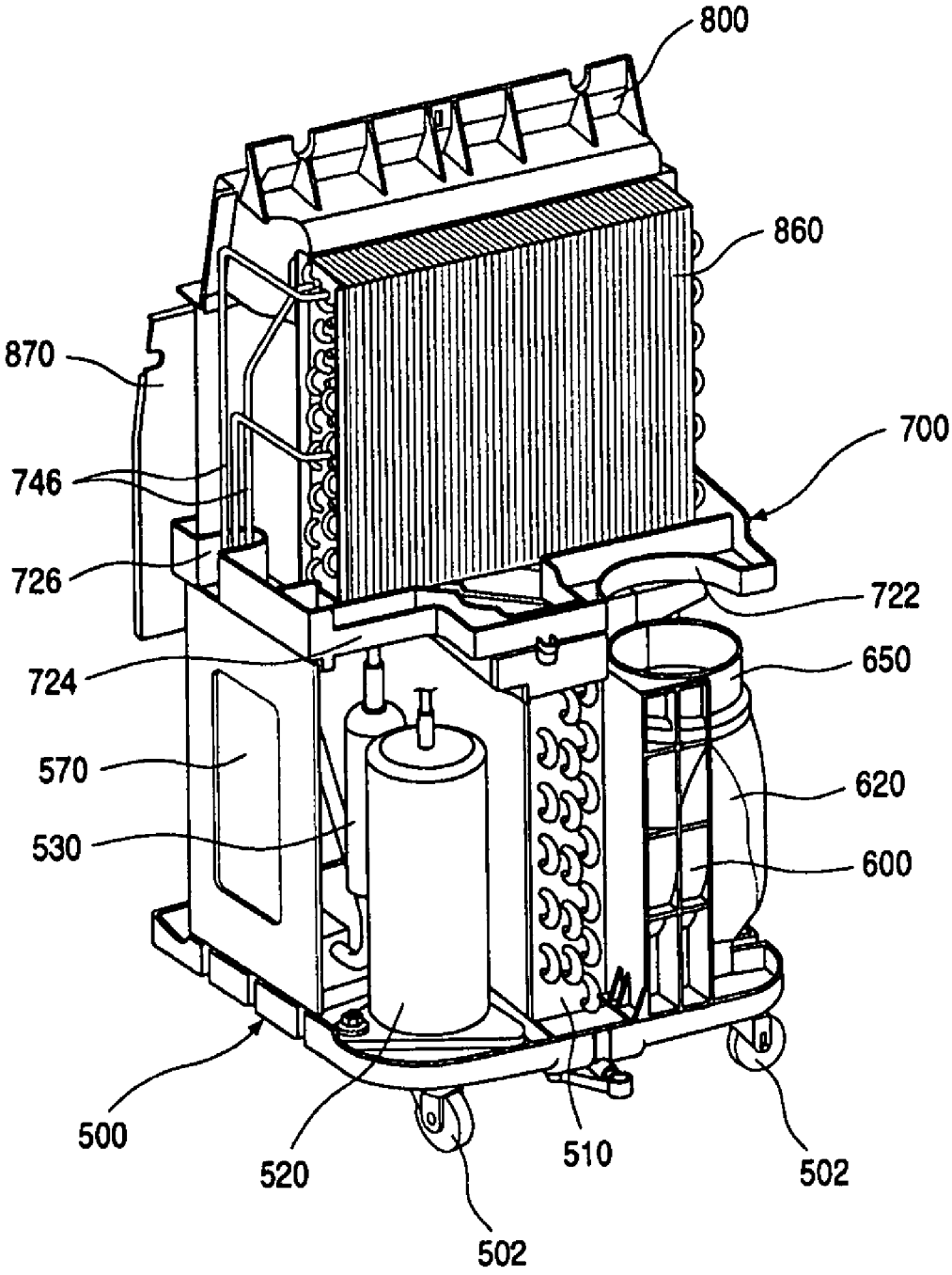

FIGS. 35 and 36 are front and rear perspective views of an inner construction of the air conditioner according to an embodiment of the present invention.

Referring to FIGS. 35 and 36, the control box 870 is installed to pass in a vertical direction in the control box installation opening 720. Also, the components provided in the control box 870 may protrude from below the control box 870.

As described above, a coolant pipe 746 passes vertically through a pipe passing groove 726, and the working hole 724 is disposed on top of the compressor 520. Accordingly, when a protective cap (not shown) is to be installed at the top of the compressor 520, a user may insert the protective cap through the top of the work hole 724.

Also, the duct avoiding grooves are disposed at the tops of the exhaust guides 650. Thus, while not shown in the diagrams, when the lower end of the exhaust guide element 400 connected and installed on the exhaust guide 650, the front portion of the exhaust guide element 400 is disposed inside the duct avoiding groove 722.

Additionally, the support angle 580 is installed between the right upper end of the main drain pan 700 and the base pan 500 to support the main drain pan 700, and the support angle 580 is installed through inserting it from the top of the angle hole 740.

Figure 37:
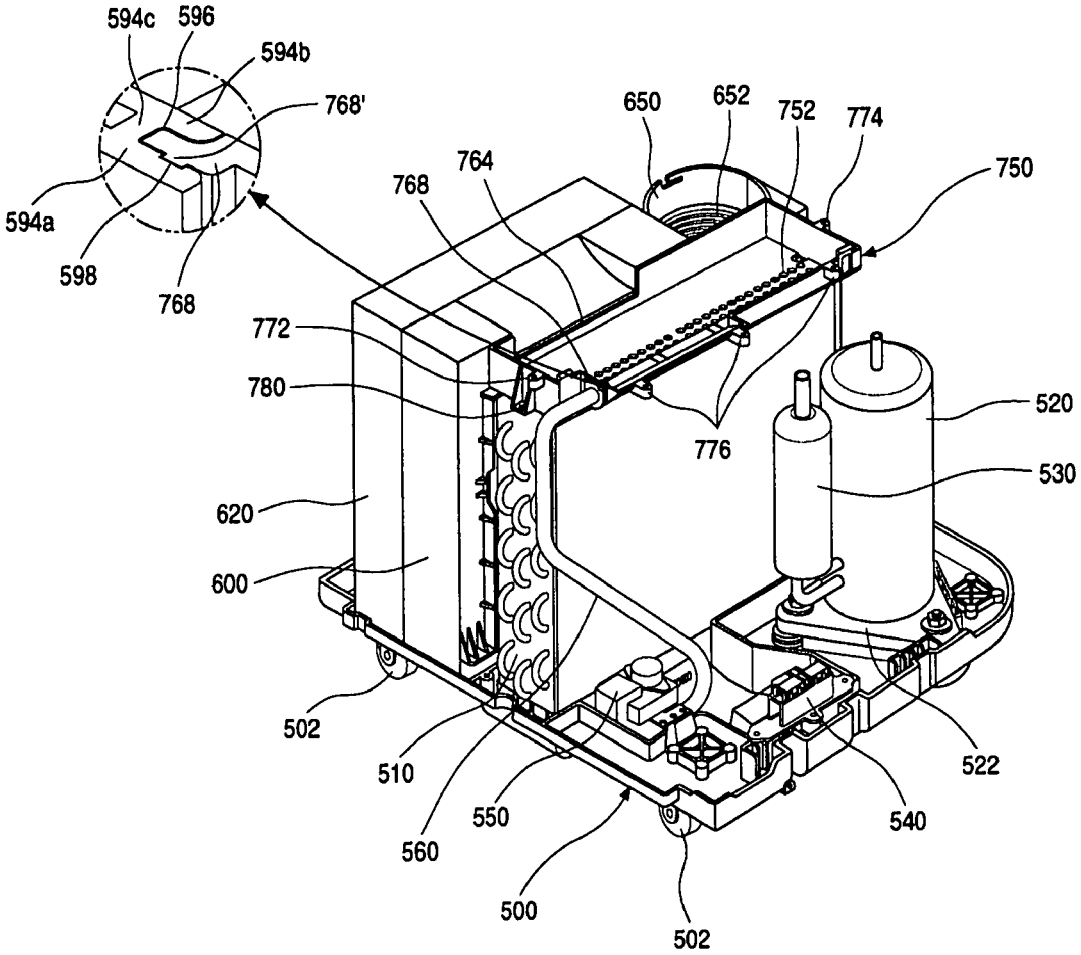
FIG. 37 is a perspective view of a sub-drain pan installed in the air conditioner according to an embodiment of the present invention.

FIG. 37 is a perspective view of a sub-drain pan installed in the air conditioner according to an embodiment of the present invention.

Referring to FIG. 37, the sub-drain pan 750 is installed above the first heat exchanger 510. Accordingly, screws or other fastening members are passed through and fixed in the heat exchange coupling members 780 and 782 to couple the sub-drain pan 750 to the top of the first heat exchanger 510. Here, when the heat exchanger support rib 784 is contacted by the right upper end of the first heat exchanger 510, the first heat exchanger 510 is prevented from falling over to the right.

The plurality of orifice coupling ribs 786 are inserted in the orifice fastening groove (not shown) formed on the lower orifice 600, allowing the coupling of the sub-drain pan 750 and the lower orifice 600.

Also, the connector coupling part 768 of the sub-drain pan 750 has the upper end of the condensed water pipe 560 fixed thereto. Thus, the condensed water in the base pan 500 is pumped by the condensed water pump 550 through the condensed water pipe 560 to flow to the sub-drain pan 750.

The condensed water that is supplied to the sub-drain pan 750 through the condensed water pipe 560 flows to the drain guide surface 760, and is guided by the drain guide grooves 762 to flow to the bottom **750*a* of the sub-drain pan 750. Here, the condensed water that collects in the main drain pan 700 falls to the bottom of the sub-drain pan 750**.

The condensed water that thus falls to the bottom **750*a* of the sub-drain pan 750 moves to the falling holes 752 by means of the incline of the bottom 750*a* and passes through the sub-drain pan 750. When the condensed water reaches the falling guide ribs 754 below, it flows downward along the falling guide ribs 754 in the right side portion of the first heat exchanger 510**.

Then, the condensed water that flows downward along the right side portion of the first heat exchanger 510 is evaporated by means of the heat generated from the first heat exchanger 510 and the air that flows through the lower grill 330 and passes through the first heat exchanger 510.

Meanwhile, the condensed water which fails to evaporate by the first heat exchanger 510 or newly generated condensed water falls down to the heat exchanger installing part 504 as shown in FIG. 25. The condensed water falling down to the heat exchanger installing part 504 is collected on the water collecting space 516. Since the bottom surface of the heat exchanger installing part 504 slants toward the right, the condensed water of the heat exchanger installing part 504 passes through the base flowing slot 506 and is collected in the water collecting space 516.

The condensed water collected in the water collecting space 516 passes through the first foreign particle shielding rib 532 and is filtered to eliminate a foreign particle mixed in the condensed water. The first filtered condensed water is introduced into the water collecting hole 534, and is again filtered by the second foreign particle shielding rib 536 to eliminate a foreign particle contained therein.

The condensed water introduced into the water collecting slot 534 is pumped by the condensed water pump 550 and is fed to the sub-drain pan 750 along the condensed water pipe 560. The flow operation of the condensed water in the sub-drain pan 750 is the same as the contents described above.

And, when the condensed water pump 550 gets out of order or is not normally operated and thus the amount of the condensed water collected on the upper surface of the base pan 500 is too much, the bladder member 910 of the condensed water detector 540 rotates and moves up.

In concrete, when the amount of the condensed water collected in the water collecting space increases, a lower end of the bladder member 910 is immersed in the condensed water. Thus, the lower end of the bladder member 910 is shielded, air is confined in the inside of the bladder hole 912. As a result, the bladder member 910 moves up by the buoyancy of the shielded air. That is, the bladder member 910 is rotated clockwise with the hinge shaft 914 acting as a clockwise axis (see FIG. 31).

Thus, the upper end of the bladder member 910 closely contacts the pair of electrode terminals 934. That is, the bladder member 910 rotates centered about the hinge shaft 914, so that the upper end of the bladder member 910 and the pair of electrode terminals 934 spaced apart from each other become in contact with each other. More accurately, the conducting member 932 attached on the right upper side of the bladder member 910 becomes in contact with the pair of electrode terminals 934, respectively.

Thus, as the conducting member 932 becomes in contact with the pair of electrode terminals 934, current flows through the electrode terminals 934 and accordingly a message that the base pan 500 is full of condensed water is displayed on the display part 125 of the front frame 100. For example, message, such as 'full water' or 'FULL' is displayed.

Accordingly, a user can recognize the message displayed on the display part 125 from an outward position of the air conditioner, i.e., can know that the condensed water is much collected on the upper surface of the base pan 500.

Accordingly, the user uncovers the drain pipe cover 904 covered on the rear end of the condensed water drain pipe 902 such that the rear side of the condensed water drain pipe 902 is opened. As a result, the condensed water collected on the upper surface of the base pan 500 flows backward along the condensed water drain hole 528 and is drained to the rear side through the condensed water drain pipe 902.

After the condensed water collected on the upper surface of the base pan 500 is completed, the user inserts the cover cap 904*a* into the rear side of the condensed water drain pipe 902. At this time, the cover cap 904*a* is securely inserted into the rear side of the saw tooth-shaped condensed water drain pipe 902, so that it is not easily released.

When the condensed water collected on the upper surface of the base pan 500 is drained and thus the condensed water level is lowered, the bladder member 910 rotates in an opposite direction to the above direction. That is, the bladder member 910 rotates counterclockwise centered about the hinge shaft 914 (see FIG. 31).

Accordingly, the conducting member 932 contacting the pair of electrode terminals 934 is separated therefrom, so that current does not flow between the pair of electrode terminals 934. As a result, the message 'full water' or 'FULL' on the display part 125 disappears.

Figure 38:
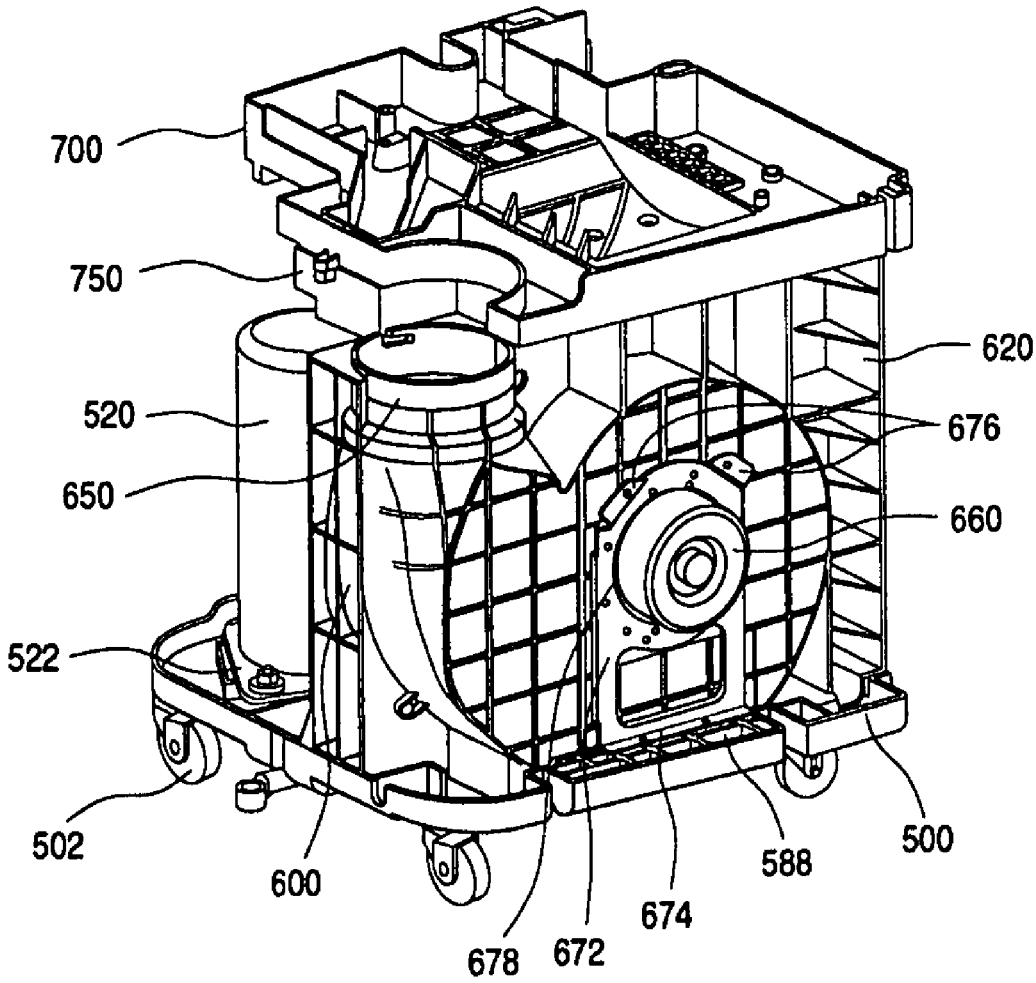
FIG. 38 is a perspective view of a motor support according to an embodiment of the present invention.

FIG. 38 shows that the lower motor 660 is supported by the lower motor support 670. Referring to FIG. 38, the lower motor 660 is partially protruded frontward through the motor penetration hole 678, and the base coupling part 674 is coupled to the motor support part 588 of the base pan 500. Also, as described above, the main body plate 672 of the lower motor support 670 closely contacts the lower air guide 620, and the air guide coupling part 676 positioned at the upper side of the main body plate 672 is fixed to the lower air guide 620 by screws.

It will be apparent to those skilled in the art that various modifications and variations can be made in the present invention. Thus, it is intended that the present invention covers the modifications and variations of this invention provided they come within the scope of the appended claims and their equivalents.

For example, while the above embodiments show and describe that when condensed water is fully collected on the base pan 500, the message indicating a full water level is displayed on the display part 125 of the front frame 100, it will be apparent to those skilled in the art that the position of the display part 125 and/or the message is modified or varied.

Also, it will be understood that the message is displayed on the display part and at the same time a buzzer rings such that a user can recognize the amount of the condensed water visually and aurally.

What is claimed is:

1. An air conditioner comprising:

front and rear frames that define an outer appearance of the air conditioner;

a main drain pan that is provided between the front and rear frames and divides an inner space between the front and rear frames into upper and lower halves;

first and second heat exchangers that are respectively provided at the lower half and the upper half for allowing air to be heat-exchanged with refrigerant;

an indoor blower unit that is provided at the upper half for generating intake and exhaust of indoor air;

an outdoor blower unit that is provided at the lower half for guiding an airflow direction of air that is heat exchanged at the first heat exchanger;

a base pan that defines a lower outer appearance of the air conditioner and supports a load of a plurality of components;

a condensed water detector detecting the amount of condensed water collected on the base pan; and drain control means for controlling a drain of the condensed water, the drain control means comprising a condensed water drain pipe protruded from one surface of the base pan toward one direction to guide the drain of the condensed water and a drain pipe cover selectively shielding the condensed water drain pipe, wherein the drain pipe cover comprises:

a cover cap covering one end of the condensed water drain pipe;

a cover coupling part coupled to the base pan; and a cover connecting part connecting the cover cap and the cover coupling part.

2. The air conditioner according to claim 1, further comprising:

a display part installed at one side of the front frame to display the amount of the condensed water on an external screen thereof according to a signal transmitted by the condensed water detector.

3. The air conditioner according to claim 1, wherein the condensed water detector comprises:

a bladder member moving up and down depending on the amount of the condensed water;

a supporting member supporting the bladder member; and switching means provided in each of the bladder member and the supporting member and switched On or Off depending on the amount of the condensed water.

4. The air conditioner according to claim 3, wherein the bladder member is rotatably installed in the supporting member.

5. The air conditioner according to claim 1, wherein the drain pipe cover is fixedly installed on one surface of the base pan and made of a flexible material which is capable of bending.

6. The air conditioner according to claim 1, wherein the condensed water drain pipe has a saw-tooth-shaped section.

7. An air conditioner comprising:

a base pan constituting a lower appearance;

a blower unit provided at one side of the base pan to guide a flow of air;

a motor providing a fan with a rotational power; and a motor support installed on the base pan to support the motor, wherein the motor support comprises:

a main body plate closely contacting one surface of the blower unit;

a base coupling part formed at a lower side of the main body plate and closely contacting the base plate; and an air guide coupling part formed at an upper side of the main body plate and coupled to the blower unit wherein the base pan comprises a housing base recess recessed for avoiding an interference between the blower unit and the base pan.

8. An air conditioner comprising:

front and rear frames that define an outer appearance of the air conditioner;

a main drain pan that is provided between the front and rear frames and divides an inner space between the front and rear frames into upper and lower halves;

an indoor blower unit that is provided at the upper half for generating intake and exhaust of indoor air;

first and second heat exchangers that are respectively provided at the lower half and the upper half for allowing air to be heat-exchanged with refrigerant;

an outdoor blower unit that is provided at the lower half for guiding an airflow direction of air that is heat exchanged at the first heat exchanger; and a base pan that defines a lower outer appearance of the air conditioner and supports a load of a plurality of components, wherein the base pan comprises a heat exchanger installing part in which the first heat exchanger is installed, and the heat exchanger installing part includes a plurality of partition supporting ribs to form a space where condensed water is movable.

9. The air conditioner according to claim 8, wherein the heat exchanger installing part has a water collecting space where condensed water that has fallen onto an upper surface of the base pan is collected, and a foreign particle shielding rib for filtering a foreign particle contained in the condensed water introduced into the water collecting space is formed at one side of the water collecting space.

10. The air conditioner according to claim 8, further comprising a condensed water pump installed at one side of the base pan to pump the condensed water collected on the base pan and supply the condensed water to a sub-drain pan, wherein the base pan where the condensed water pump is installed comprises a water collecting recess recessed downward from an upper surface of the base pan to collect the condensed water.

11. The air conditioner according to claim 10, wherein a foreign particle shielding rib filtering a foreign particle contained in the condensed water introduced into the water collecting recess is formed at one side of the water collecting recess.

12. The air conditioner according to claim 11, wherein the foreign particle shielding rib comprises a plurality of protrusions formed in a column.

13. The air conditioner according to claim 7, wherein the plurality of partition supporting ribs comprises:

a base flowing slot penetrated and through which the condensed water can pass; and an air shielding rib formed at both ends of at least one of the partition supporting ribs, for preventing air flow in and out the partition supporting ribs.

14. The air conditioner according to claim 13, wherein the heat exchanger installing part comprises separation walls respectively formed at both sides thereof, for preventing left and right directional flowing of the condensed water, the separation walls having a higher height than at least one of the partition supporting ribs.

* * * * *